US010156801B2

(12) United States Patent
Nagata et al.

(10) Patent No.: US 10,156,801 B2
(45) Date of Patent: Dec. 18, 2018

(54) TONER

(71) Applicants: Kohsuke Nagata, Shizuoka (JP); Shinya Nakayama, Shizouka (JP); Tsuyoshi Sugimoto, Shizouka (JP); Daisuke Asahina, Shizuoka (JP); Susumu Chiba, Shizuoka (JP)

(72) Inventors: Kohsuke Nagata, Shizuoka (JP); Shinya Nakayama, Shizouka (JP); Tsuyoshi Sugimoto, Shizouka (JP); Daisuke Asahina, Shizuoka (JP); Susumu Chiba, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/914,291

(22) PCT Filed: Aug. 13, 2014

(86) PCT No.: PCT/JP2014/071693
§ 371 (c)(1),
(2) Date: Feb. 25, 2016

(87) PCT Pub. No.: WO2015/033774
PCT Pub. Date: Mar. 12, 2015

(65) Prior Publication Data

US 2016/0209767 A1 Jul. 21, 2016

(30) Foreign Application Priority Data

Sep. 6, 2013 (JP) ..... 2013-184669

(51) Int. Cl.
*G03G 9/087* (2006.01)
*G03G 9/08* (2006.01)
*G03G 15/08* (2006.01)

(52) U.S. Cl.
CPC ..... *G03G 9/08755* (2013.01); *G03G 9/0821* (2013.01); *G03G 9/08793* (2013.01); *G03G 9/08795* (2013.01); *G03G 9/08797* (2013.01); *G03G 15/08* (2013.01)

(58) Field of Classification Search
CPC ..... G03G 9/08755; G03G 9/0821
USPC ..... 430/123.52
See application file for complete search history.

(56) References Cited

U.S. PATENT DOCUMENTS 3,683,018 A * 8/1972 Longland, Jr. ..... C07C 51/265 562/414
5,955,234 A 9/1999 Matsunaga et al.
7,261,989 B2 8/2007 Sugiura et al.
7,318,989 B2 1/2008 Kotsugai et al.
7,455,942 B2 11/2008 Nagatomo et al.
8,673,528 B2 3/2014 Sugimoto et al.
2004/0072091 A1 4/2004 Mochizuki et al.
2004/0115550 A1 6/2004 Sugiura et al.
2005/0026064 A1 2/2005 Sugiura et al.
2005/0089786 A1 4/2005 Sugiura et al.
2005/0089787 A1 4/2005 Uchinokura et al.
2005/0208408 A1 9/2005 Uchinokura et al.
2006/0029433 A1 2/2006 Saito et al.
2008/0014527 A1 1/2008 Kotsugai et al.
2008/0044753 A1 2/2008 Hirota
2008/0070151 A1 3/2008 Sugimoto et al.
2008/0118855 A1 5/2008 Nakayama et al.
2008/0227002 A1 9/2008 Moriya et al.
2008/0261131 A1 10/2008 Nakayama et al.
2008/0280218 A1 11/2008 Sabu et al.
2008/0280219 A1 11/2008 Nakayama et al.
2008/0318143 A1 12/2008 Nakayama et al.
2008/0318144 A1 12/2008 Watanabe et al.
2008/0318148 A1 12/2008 Sugimoto et al.
2009/0074467 A1 3/2009 Seshita et al.
2009/0092917 A1 4/2009 Sugimoto et al.
2009/0104555 A1 4/2009 Wakamatsu et al.
2009/0214973 A1 8/2009 Sugimoto et al.
2009/0325099 A1 12/2009 Watanabe et al.
2010/0035170 A1 2/2010 Sugimoto et al.
2011/0281213 A1 11/2011 Sakashita et al.
2012/0064447 A1 3/2012 Hozumi et al.
2012/0065357 A1 3/2012 Yamauchi et al.
2012/0082926 A1 4/2012 Suzuki et al.
2012/0282000 A1 11/2012 Nakayama et al.
2012/0295193 A1 11/2012 Hanatani et al.
2013/0045442 A1 2/2013 Moriya et al.
2013/0059247 A1* 3/2013 Sugimoto ..... G03G 9/0821 430/109.4
2013/0078563 A1 3/2013 Nakayama et al.
2013/0095422 A1 4/2013 Yamamoto et al.
2013/0108950 A1 5/2013 Yamamoto et al.
2013/0115550 A1 5/2013 Amemori et al.
2013/0143155 A1 6/2013 Santo et al.
2013/0157183 A1 6/2013 Santo et al.
2013/0157185 A1 6/2013 Sakashita et al.
2013/0157193 A1* 6/2013 Moritani ..... G03G 9/08728 430/109.4

(Continued)

FOREIGN PATENT DOCUMENTS

JP 2579150 11/1996
JP 10-171156 6/1998

(Continued)

OTHER PUBLICATIONS

Borsenberger, P.M.; Weiss, D.S., "Introduction" in Organic Photoreceptors for Imaging Systems. Marcel-Dekker, Inc.: New York, NY, 1993; pp. 6-17.*

(Continued)

*Primary Examiner* — Christopher D RoDee
(74) *Attorney, Agent, or Firm* — Oblon, McClelland, Maier & Neustadt, L.L.P.

(57) ABSTRACT

A toner, including: a colorant; a binder resin; and a releasing agent, wherein the binder resin includes a polyester resin, and the toner satisfies requirements (1) and (2) below: (1): $G'(50) \geq 3.0 \times 10^7$ Pa and $1.0 \times 10^5$ Pa $\leq G'(60) \leq 1.0 \times 10^7$ Pa, where G'(50) is a storage modulus at 50° C. of the toner and G'(60) is a storage modulus at 60° C. of the toner; and (2): a spin-spin relaxation time of the toner at 50° C. measured by solid echo method of pulse NMR is 1.0 ms or shorter.

20 Claims, 3 Drawing Sheets

(56) References Cited

U.S. PATENT DOCUMENTS

| | | | | |
|---|---|---|---|---|
| 2013/0236826 | A1 | 9/2013 | Makabe et al. | |
| 2013/0244011 | A1 | 9/2013 | Sabu et al. | |
| 2013/0244153 | A1 | 9/2013 | Nakayama et al. | |
| 2013/0244154 | A1 | 9/2013 | Yamamoto et al. | |
| 2013/0244168 | A1 | 9/2013 | Yamashita et al. | |
| 2013/0252158 | A1 | 9/2013 | Yamada et al. | |
| 2013/0260298 | A1 | 10/2013 | Amemori et al. | |
| 2013/0337374 | A1 | 12/2013 | Sugimoto et al. | |
| 2014/0023965 | A1 | 1/2014 | Chiba et al. | |
| 2014/0051019 | A1 | 2/2014 | Sekiguchi et al. | |
| 2014/0065534 | A1 | 3/2014 | Amemori et al. | |
| 2014/0080046 | A1 | 3/2014 | Asahina et al. | |
| 2014/0080050 | A1 | 3/2014 | Asahina et al. | |
| 2014/0270874 | A1 | 9/2014 | Hase et al. | |
| 2014/0272689 | A1 | 9/2014 | Yamashita et al. | |
| 2014/0301757 | A1 | 10/2014 | Sakashita et al. | |
| 2015/0268574 | A1* | 9/2015 | Miyaake ..... | G03G 9/08733 430/109.4 |

FOREIGN PATENT DOCUMENTS

| | | |
|---|---|---|
| JP | 11-133665 | 5/1999 |
| JP | 2001-158819 | 6/2001 |
| JP | 2002-287400 | 10/2002 |
| JP | 2002-351143 | 12/2002 |
| JP | 2004-046095 | 2/2004 |
| JP | 2005-172886 | 6/2005 |
| JP | 2006-235585 | 9/2006 |
| JP | 2007-271789 | 10/2007 |
| JP | 2010-015159 | 1/2010 |
| JP | 2013-054178 | 3/2013 |

OTHER PUBLICATIONS

International Search Report dated Sep. 16, 2014 for counterpart International Patent Application No. PCT/JP2014/071693 filed Aug. 13, 2014.

* cited by examiner

TONER

TECHNICAL FIELD

The present invention relates to a dry toner for developing an electrostatic latent image in fields such as electrophotography, electrostatic recording, and electrostatic printing.

BACKGROUND ART

In recent years, toners have been desired to have small particles size and hot offset resistance for giving high quality output images, low temperature fixing ability for energy saving, and heat resistant storage stability for resisting high-temperature, high-humidity environments during storage or transport after production. Particularly, low temperature fixing ability is very important quality of a toner, as power consumption for fixing occupies a large part in the power consumption for an entire image forming process.

Conventionally, toners produced by a kneading and pulverizing method have been used. The toner produced by the kneading and pulverizing method have problems that it is difficult to reduce the particle size thereof, and shapes of particles are uneven and a particle diameter distribution thereof is broad, which result in unsatisfactory quality of output images, and a large quantity of energy is required for fixing such toner. In the case where wax (i.e., a releasing agent) is added to the toner for improving fixing ability, moreover, the toner produced by the kneading and pulverizing method contains a large amount of the wax present near toner surfaces, as a kneaded product is cracked from an interface of wax during pulverizing. As a result of this, a releasing effect is exhibited, but on the other hand, the toner tends to cause toner deposition (i.e., filming) on a carrier, a photoconductor, and a blade. Therefore, such toner is not satisfactory in view of its characteristics on the whole.

To encounter the aforementioned problems associated with the kneading and pulverizing method, a production method of a toner in accordance with a polymerization method has been proposed. A toner produced by the polymerization method is easily produced as small particles, has a sharp particle diameter distribution compared to that of the toner produced by the pulverizing method, and can encapsulate a releasing agent therein. As a production method of a toner in accordance with the polymerization method, proposed is a method for producing a toner using an elongation reaction product of urethane-modified polyester as a toner binder, for the purpose of improving low temperature fixing ability, and hot offset resistance (see PTL 1).

Moreover, proposed is a production method of a toner, which is excellent in all of heat resistant storage stability, low temperature fixing ability, and hot offset resistance, as well as excellent in powder flowability and transfer ability, when a toner is produced as a small-diameter toner (see PTLs 2 and 3).

Further, disclosed is a production method of a toner having a maturing step for producing a toner binder having a stable molecular weight distribution, and achieving both low temperature fixing ability and (see PTLs 4 and 5).

However, these proposed techniques do not provide a toner having a high level of low temperature fixing ability, which has been demanded in recent years.

For the purpose of achieving a high level of low temperature fixing ability, therefore, proposed is a toner containing a resin including a crystalline polyester resin, and a releasing agent, and having a phase separation structure, where the resin and the releasing agent (e.g., wax) are incompatible to each other in the form of sea-islands (see PTL 6).

Moreover, proposed is a toner containing a crystalline polyester resin, a releasing agent, and a graft polymer (see PTL 7).

These proposed techniques can achieve low temperature fixing, as the crystalline polyester resin is rapidly melted, compared to a non-crystalline polyester resin. The proposed toners can have desired low temperature fixing ability and desired heat resistant storage stability at the same time, but have a problem when used in a high-speed apparatus that increased stress applied to the toner will form aggregates of the toner particles, and cause a cleaning doctor clog to form white voids (white voids after transfer) of the toner on output toner images. Moreover, in the case of toners containing a crystalline polyester resin, they have a problem of forming aggregates of the toner particles in high-temperature, high-humidity environments.

Accordingly, there has been a need to provide a high-quality toner that has desired low temperature fixing ability and desired heat resistant storage stability at the same time, and can prevent formation of white voids after transfer.

CITATION LIST

Patent Literature

PTL 1: Japanese Patent Application Laid-Open (JP-A) No. 11-133665
PTL 2: JP-A No. 2002-287400
PTL 3: JP-A No. 2002-351143
PTL 4: Japanese Patent (JP-B) No. 2579150
PTL 5: JP-A No. 2001-158819
PTL 6: JP-A No. 2004-46095
PTL 7: JP-A No. 2007-271789

SUMMARY OF INVENTION

Technical Problem

Under the current circumstances of the prior arts, an object of the present invention is to provide a high-quality toner that has desired low temperature fixing ability and desired heat resistant storage stability at the same time, and can prevent formation of white voids after transfer and hot offset.

Solution to Problem

The above problems can be solved by the following "toner" of the present invention.

That is, it is a toner including: a colorant; a binder resin; and a releasing agent, wherein the binder resin contains at least a polyester resin, and the toner satisfies requirements (1) and (2) below:

(1): $G'(50) \geq 3.0\times10^7$ Pa and $1.0\times10^5$ Pa $\leq G'(60) \leq 1.0\times10^7$ Pa, where G'(50) is a storage modulus at 50° C. of the toner and G'(60) is a storage modulus at 60° C. of the toner; and (2): a spin-spin relaxation time of the toner at 50° C. measured by solid echo method of pulse NMR is 1.0 ms or shorter.

Advantageous Effects of Invention

As can be understood from the following detailed and specific description, the present invention exhibits a remarkably excellent effect of being able to provide a high-quality toner that has desired low temperature fixing ability and desired heat resistant storage stability at the same time, and can prevent formation of white voids after transfer and hot offset.

DESCRIPTION OF EMBODIMENTS (Toner)

Figure 1:
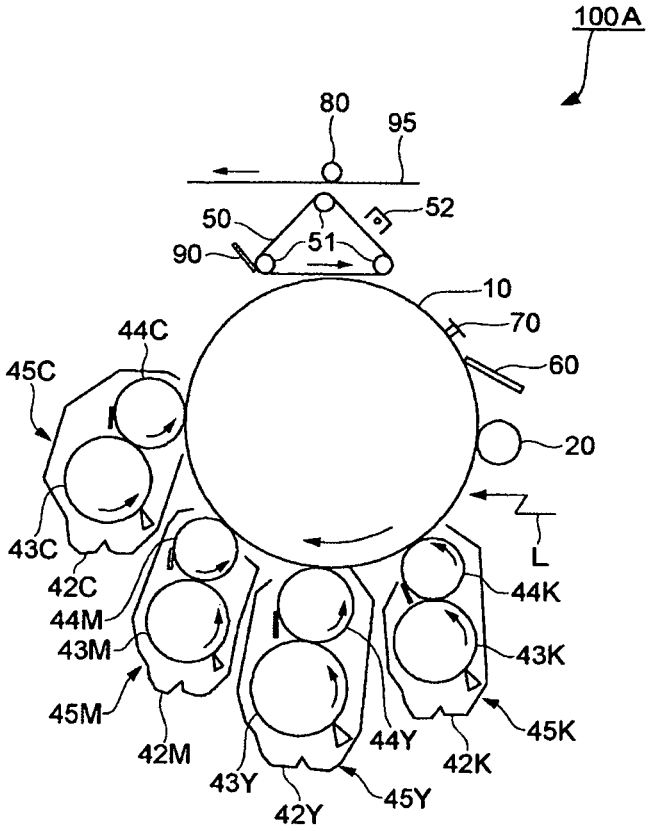
FIG. 1 is a schematic view of one example of an image forming apparatus of the present invention.

The present invention will be described in detail below.

A toner of the present invention, unlike conventional toners, has one feature as described in the above Requirement (1) that the storage modulus G' drastically changes at a slight difference in temperature between 50° C. and 60° C. The toner having this feature has desired sharp melt property at low temperature and desired storage stability at the same time. Particularly severe conditions in determining storage stability of a toner are, for example, cases where the toner is stored in an image forming machine including a developing site to be used for developing. A temperature inside the machine where the toner exists is generally higher than that of a room where the machine is placed, and the toner is always receiving mechanical stress by stirring. Ideally, even if used for developing under such environment, individual toner particles are hard and smooth to show high flowability, while the toner shows is sharply melt at a low temperature of about 60° C. for a short period of time upon fixing with heating. The toner of the present invention realizes this ideal property.

Specifically, the temperature of 50° C. is a temperature which the surface temperatures of a toner bearing member, a photoconductor, and peripheral members therearound reach when image formation is continuously performed in an image forming apparatus. The toner experiences a developing step at this temperature range. Hence, when the toner is prone to deform at this temperature (50° C.), toner particles aggregate in a developing part and adhere to the toner bearing member, which forms dot stains derived from the aggregates of the toner particles on the formed images, forms white voids on the formed images due to abnormal supply of the toner to the photoconductor, and degrades heat resistant storage stability. For this reason, the toner is required to be difficult to deform at this temperature. As a result, in the present invention, the storage modulus at 50° C. needs to be $3.0\times10^7$ Pa or more.

No particular problems will arise so long as the storage modulus at 50° C. of the toner is $3.0\times10^7$ Pa or more, but it is preferably $1.0\times10^8$ Pa or more. When the storage modulus G'(50) at 50° C. is less than $3.0\times10^7$ Pa, the toner will become insufficient in hot offset resistance and heat resistant storage stability. The storage modulus G' at 50° C. falling within the above preferable range is advantageous in that the toner is more excellent in low temperature fixing ability and heat resistant storage stability.

The temperature of 60° C. is a temperature which the surface temperatures of a toner bearing member, a photoconductor, and peripheral members therearound are believed to reach upon the start of paper feeding in a normal temperature environment. Reduction in the storage modulus at this temperature realizes low temperature fixing ability. The storage modulus at 60° C. of the toner is $1.0\times10^5$ Pa≤G'(60)≤$1.0\times10^7$ Pa, preferably $5.0\times10^5$ Pa≤G'(60)≤$5.0\times10^6$ Pa. When the G'(60) is less than $1.0\times10^5$ Pa, the toner is degraded in hot offset resistance. When the G'(60) is more than $1.0\times10^7$ Pa, the toner is degraded in low temperature fixing ability.

(Method for Realizing Storage Modulus)

One method for adjusting the storage modulus G'(50) at 50° C. of the toner to be $3.0\times10^7$ Pa or more without degrading sharp melt property thereof is blending a non-crystalline resin with a crystalline resin (resin C) suitable for showing sharp melt property. Another method therefor is using a resin in which a non-crystalline portion has been introduced into a structure of a crystalline resin.

In one specific example, a crystalline resin (resin C) is used in combination with non-crystalline resins which are a non-crystalline resin having a high molecular weight (a non-linear chain resin A which is a low Tg component (Resin A)) and a non-crystalline resin containing an aromatic resin at a higher rate than an aliphatic resin (Resin B). Flowability of the non-linear chain resin A having a high molecular weight is suppressed upon melting because of the high molecular weight of the non-linear chain resin A even though the non-linear chain resin A has a low Tg. In another specific example, an aromatic moiety is introduced into a structure of a non-crystalline polymer molecule having a high molecular weight, and the product is used.

In this case, for example, it is possible that a trivalent or higher polyfunctional acid and/or a trihydric or higher polyfunctional polyol are/is used in synthesis of the resin A, to thereby introduce a three-dimensional structure portion into a polyester polymer to impart rubber-like elasticity to it. Alternatively, it is possible to blend a resin exhibiting rubber-like elasticity derived from its three-dimensional structure portion. Also, use of a trivalent or higher polyfunctional amine or polyol as an active hydrogen group-containing compound to be reacted with an isocyanate group in synthesis of a urethane-modified polyester contributes to introduction of a three-dimensional structure portion into a polyester polymer and to imparting rubber-like elasticity to it.

Furthermore, for example, when the resin B is a non-crystalline polyester using alkylene oxide-added bisphenol diol, adjusting an amount of alkylene oxide to be added or a ratio of, for example, ethylene oxide and propylene oxide to adjust properties of segments in the synthesis of the resin B can contribute to controlling the storage modulus G'(50) at 50° C. to be $3.0\times10^7$ Pa or more. Preferable specific exemplary embodiments of them will be described in detail below.

The storage modulus G'(60) at 60° C. can be adjusted to $1.0\times10^5$ Pa to $1.0\times10^7$ Pa in the following manner. For example, a sharp melt property can be obtained by introduction of a long-chain aliphatic group, and this long-chain aliphatic group can also contribute to increase in molecular weight of the non-crystalline polyester as described above. Also, for example, when a long-chain aliphatic group is introduced next to a nitrogen atom and/or an oxygen atom around which the density of hydrogen bonds is high as in the case of a urethane-modified resin, it is possible to reduce influence of such high-density hydrogen bonds.

For example, in an attempt to plasticize non-crystalline polyester by using a crystalline polyester resin, there is naturally limitation on increase in amount of the crystalline polyester resin as a means for realizing low temperature fixing ability. For example, problems related to heat resistant storage stability and limitation of the amount of the crystalline polyester resin derived from crystallization may become serious.

Here, one method of avoiding this problem is controlling non-crystalline polyester to be plasticized. For example, an appropriate amount of a crystalline polyester resin is used to plasticize a non-crystalline polyester resin blended with or bonded through addition with a non-crystalline polyester resin having a low glass transition temperature due to a long-chain aliphatic moiety introduced into its polymer segment but being difficult to flow owing to high melt viscosity.

This can suitably be realized by, for example, blending the below-described non-crystalline polyester resin B having a high glass transition temperature of 40° C. to 70° C. with the below-described non-crystalline polyester resin A having a glass transition temperature in an ultra low temperature region but is difficult to flow owing to high melt viscosity, or by introducing a moiety corresponding to the resin B in the course of synthesis of the resin A. Also, it is preferable that the non-crystalline polyester resin A and the non-crystalline polyester resin B be in a compatible state or in a state where at least one of the resins as a homogeneous phase contain particles of the other resin dispersed in a sea-island form (in an alloy). Also, the storage modulus at 60° C. of the toner can be controlled to be $1.0\times10^5$ Pa≤G'(60) ≤$1.0\times10^7$ Pa by, for example, controlling the characteristic values (e.g., molecular weight and/or glass transition temperature) and/or the amount of the below-described non-crystalline polyester resin B, and/or controlling the characteristic values (e.g., melting point) and/or the amount of the below-described crystalline polyester resin C.

In this manner, the requirement "G'(50)≥$3.0\times10^7$ Pa and $1.0\times10^5$ Pa≤G'(60)≤$1.0\times10^7$ Pa" in the present invention can be achieved by combining these various kinds of means for adjusting storage modulus as a whole.

Specific preferable embodiments of them will be described below in detail and specifically.

(Loss Tangent; tan δ)

The maximum value of tan δ (i.e., a ratio (G"/G') of loss modulus G" to storage modulus G') is preferably 60° C. or lower. It is more preferably higher than 10° C. but 60° C. or lower, further preferably 20° C. to 60° C., particularly preferably 40° C. to 60° C. When the maximum value of tan δ is 10° C. or lower, the toner may be insufficient in heat resistant storage stability. When the maximum value of tan δ is higher than 60° C., the toner may be insufficient in low temperature fixing ability.

(Measurement Method of Viscoelasticity)

The storage modulus (G') and the loss tangent (tan δ) of the toner can be measured by means of, for example, a dynamic viscoelastometer (ARES, product of TA Instruments Inc.). The measurement is carried out with a frequency of 1 Hz.

Specifically, a measurement sample is formed into a pellet having a diameter of 8 mm, and a thickness of 1 mm to 2 mm, and the pellet sample is fixed to a parallel plate having a diameter of 8 mm. After that, the pellet sample is closely attached onto the parallel plate at a temperature within 10° C. to 15° C. from the Tg1st of the toner, and the temperature is maintained for 15 minutes. Thereafter, the sample is cooled to 30° C. while a load of applied by the plate to the sample is being maintained constant, and the sample is maintained at 30° C. for 48 hours. Then, the storage modulus and the loss tangent are measured by heating the thus-prepared sample to 200° C. at a heating rate of 2.0° C./min with a frequency of 1 Hz, and strain of 0.1% (in a strain control mode).

(Pulse NMR)

Pulse NMR (pulse technique NMR) is effective for indexing molecular mobility. The pulse technique NMR does not provide chemical shift information (e.g., a local chemical structure), unlike high resolution NMR. Instead, the pulse technique NMR can quickly measure relaxation times (a spin-lattice relaxation time (T1), and a spin-spin relaxation time (T2)) of a 1H nucleus that is closely related to molecular mobility. The pulse technique NMR has become widespread recently.

Examples of measurement procedures of the pulse technique NMR include a Hahn echo procedure, a solid echo procedure, a CPMG procedure (Carr Purcell Meiboom Gill procedure), and a 90° pulse procedure.

Any of them can be used suitably. In the present invention, a spin-spin relaxation time (T2) at 50° C. is measured and thus the measurement is performed by a solid echo procedure which is suitable for the measurement of a short T2. Generally, the solid echo procedure and the 90° pulse procedure are suitable for the measurement of a short T2, the Hahn echo procedure is suitable for the measurement of a middle-level T2, and the CPMG procedure is suitable for the measurement of a long T2.

A spin-spin relaxation time at 50° C. (t50), serving as an index of molecular mobility pertinent to storage stability, is 1.0 ms or shorter. When the t50 is longer than 1.0 ms, the mobility of the toner and resin at 50° C. is high and the toner easily deform and/or aggregate due to external force, causing difficulties in overseas transportation by ship and storage in summer, which is not preferred.

(Measurement Method Using Pulse NMR)

This measurement can be preformed with, for example, "MINISPEC-MQ20" (product of Bruker Optics K.K.). The measurement is performed with an observation nucleus of 1H, at a resonance frequency of 19.65 MHz, and at measurement intervals of 5 s. An attenuation curve is measured according to a solid echo procedure with a pulse sequence (90° x-Pi-180° x). Note that Pi is varied from 0.01 msec. to 100 msec., the number of data points is 100 points, a cumulative number is 32.

As a sample, toner particles (0.2 g) or particles of the resin for a toner (0.2 g) are put in a dedicated sample tube, and measured with the sample tube inserted up to an appropriate range of a magnetic field. Through this measurement, a spin-spin relaxation time (t50) at 50° C. of each sample is measured.

(TMA; Thermomechanical Analysis)

The toner preferably has a TMA compression deformation amount (TMA %) of 15% or less, where the TMA % is measured at 40° C. and a relative humidity of 70%. More preferably, the toner has a TMA % of 10% or less. The TMA % exceeding 15% means that the toner can easily deform when transported in summer or by ship. The TMA % exceeding 15% specifically means that even if the toner is excellent in static storage stability measured by, for example, the penetration test and excellent in storage stability under dry conditions, the toner is poor in storage stability under dynamic conditions including error factors. That is, the toner having a TMA % exceeding 15% is poor in blocking resistance. Considering, for example, the transportation or storage in a storehouse of the toner in summer and the temperature inside copiers, the toner particles easily adhere to each other to be degraded in transportability and transferability, leading to image failures or other failures.

(Measurement Method of TMA %)

Toner particles (5 mg) are tabletted using a tablet die 3 mm in diameter (product of Shimadzu Corporation) and the obtained tablet is tested using a thermo mechanical analyzer (EXSTAR7000, product of SII NanoTechnology Inc.). The measurement is performed in a compression mode while the tablet is heated from 0° C. to 80° C. at 2° C./min with 70% relative humidity according to JIS K7197. The compression force in this measurement is set to 100 mN. On a graph between the sample's temperature and its compression displacement (deformation rate), a compression displacement (deformation rate) at 40° C. is read and defined as TMA %.

(Difference between the glass transition temperature measured in the first heating and the glass transition temperature measured in the second heating: Tg1st−Tg2nd)

A difference (Tg1st−Tg2nd) between the glass transition temperature (Tg1st) of the toner measured in the first heating and the glass transition temperature (Tg2nd) of the toner measured in the second heating in differential scanning calorimetry (DSC) is not particularly limited and may be appropriately selected depending on the intended purpose, but it is preferably 10° C. or more.

The upper limit of the difference is not particularly limited and may be appropriately selected depending on the intended purpose, but the difference (Tg1st)−(Tg2nd) is preferably 50° C. or less.

When the difference (Tg1st)−(Tg2nd)) is 10° C. or more, the resultant toner is excellent in low temperature fixing ability, which is advantageous. The fact that the difference (Tg1st)−(Tg2nd) is 10° C. or more means that the crystalline polyester resin C and the non-crystalline polyester resins A and B, which are present in a non-compatible state before heating (before the first heating), become in a compatible state after heating (after the first heating). Note that, the compatible state after heating does not have to be a completely compatible state.

(THF Insoluble Matter of Toner)

In the toner of the present invention, a storage modulus at 60° C. [G*(60)] of THF (tetrahydrofuran) insoluble matter extracted by, for example, Soxhlet extraction preferably satisfies $G^*(60) \leq 1.0 \times 10^6$ Pa.

The toner of the present invention contains a polyester resin having rubber-like elasticity, a low Tg, and a cross-linked, and thus can achieve desired blocking resistance and desired filming resistance. The polyester resin that allows the toner to exhibit rubber-like elasticity is preferably cross-linked and/or polymerized at such a level as to have insolubility in a solvent such as THF. When the storage modulus at 60° C. [G*(60)] of THF insoluble matter is more than $1 \times 10^6$ Pa, the toner may be insufficiently melt in a fixing temperature range and degraded in low temperature fixing ability.

(Extraction Method)

The THF insoluble matter of the toner of the present invention can be extracted according to the following procedure. Specifically, 1 g of a toner is refluxed in 100 g of THF for 12 hours, to thereby be separated into THF non-dissolvable matter and THF dissolvable matter. Then, the THF is removed from the THF dissolvable matter to obtain solid matter. This solid matter and the solid matter of the THF non-dissolvable matter are dried at 40° C. for 20 hours under normal pressure and then dried under reduced pressure at 23° C. for 20 hours. The solid matter of the THF dissolvable matter after drying is used as the THF soluble matter, and the solid matter of the THF non-dissolvable matter after drying is used as the THF insoluble matter.

[Toner]

One conceivable method for improving low temperature fixing ability of a toner is lowering the glass transition temperature or the molecular weight of a non-crystalline polyester resin so that the non-crystalline polyester resin melt with a crystalline polyester resin. However, it can easily be imagined that when simply lowering the glass transition temperature or the molecular weight of the non-crystalline polyester resin to lower its melt viscosity, the resultant toner will be degraded in heat resistant storage stability and hot offset resistance upon fixing.

In the toner of the present invention, when the non-crystalline polyester resin A has a very low glass transition temperature is used, the non-crystalline polyester resin A has a property of deforming at low temperature since it a very low glass transition temperature. Hence, the non-crystalline polyester resin A has such a property that it deforms with heating and pressing upon fixing and easily adheres on recording media such as paper at low temperature. Also, since a reactive precursor of the non-crystalline polyester resin A is a non-linear chain, the non-crystalline polyester resin A has a branched structure in its molecular skeleton, and the molecular chain thereof becomes a three-dimensional network structure. As a result, the non-crystalline polyester resin A has such rubber-like properties as to deform at low temperature but not flow, enabling the toner to retain heat resistant storage stability and hot offset resistance. Note that, when the non-crystalline polyester resin A has a urethane bond or a urea bond having high cohesive energy, the obtained toner is more excellent in adhesion onto recording media such as paper. Also, the urethane bond or the urea bond behaves as a pseudo-crosslinking point to increase rubber-like properties of the polyester resin. As a result, the obtained toner is more excellent in heat resistant storage stability and hot offset resistance.

Specifically, as described above, the toner of the present invention, by combining the non-crystalline polyester resin A having a high molecular weight, which has a glass transition temperature in an ultra low temperature region but is difficult to flow owing to high melt viscosity, with the non-crystalline polyester resin B containing an aromatic resin at a high rate, and the crystalline polyester resin C, it becomes possible to maintain heat resistant storage stability and hot offset resistance even when the glass transition temperature of the toner is set to be lower than that of a conventional toner; and by making the toner have a low glass transition temperature, the toner is excellent in low temperature fixing ability. Needless to say, the above explains one preferable example for obtaining the toner of the present invention, and does not intend to deny any probability that other productions methods for producing the toner of the present invention will be developed in the near future. However, the present invention relates to the toner itself not the production method thereof, and hence such probability of production will not be discussed anymore.

<Non-Crystalline Polyester Resin A>

The non-crystalline polyester resin A contains a diol component as a constituent component thereof, and the diol component contains an aliphatic diol having 3 to 10 carbon atoms in an amount of 50 mol % or more. The non-crystalline polyester resin A preferably contains a trivalent or higher acid or a trihydric or higher alcohol as a crosslink component.

The non-crystalline polyester resins may be used alone or in combination of two or more thereof.

The non-crystalline polyester resin preferably contains a urethane bond, a urea bond, or both, since it is more excellent in adhesion onto recording media such as paper. Also, as a result of containing a urethane bond, a urea bond, or both in the non-crystalline polyester resin, the urethane bond or the urea bond behaves as a pseudo-crosslinking point to increase rubber-like properties of the non-crystalline polyester resin. As a result, the obtained toner is more excellent in heat resistant storage stability and hot offset resistance.

—Diol Component—

The diol component may be appropriately selected depending on the intended purpose so long as it contains an aliphatic diol having 3 to 10 carbon atoms in an amount of 50 mol % or more. Examples thereof include aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diols containing an oxyalkylene group such as diethylene glycol, triethylene glycol, dipropylene glycol, polyethylene glycol, polypropylene glycol and polytetramethylene glycol; alicyclic diols such as 1,4-cyclohexanedimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide.

Among them, aliphatic diols having 4 to 12 carbon atoms are preferred.

These diols may be used alone or in combination of two or more thereof.

In addition, when the number of carbon atoms of a main chain of the constituent diol component is an odd number and an alkyl group is contained in a side chain thereof, the non-crystalline polyester resin A can exhibit rubber-like elasticity with retaining high thermal deformability of the resin in a fixable temperature range, so that the obtained toner is more excellent in low temperature fixing ability and blocking resistance.

—Dicarboxylic Acid—

The dicarboxylic acid constituting the non-crystalline polyester is not particularly limited and may be appropriately selected depending on the intended purpose. Examples thereof include aliphatic dicarboxylic acids and aromatic dicarboxylic acids. Besides, anhydrides thereof, lower (C1 to C3) alkyl-esterified compounds thereof, or halides thereof may also be used.

The aliphatic dicarboxylic acid is not particularly limited and may be appropriately selected depending on the intended purpose. Examples thereof include succinic acid, adipic acid, sebacic acid, decanedioic acid, maleic acid, and fumaric acid.

The aromatic dicarboxylic acid is not particularly limited and may be appropriately selected depending on the intended purpose. Examples thereof include phthalic acid, isophthalic acid, terephthalic acid, and naphthalenedicarboxylic acids. Among them, aliphatic dicarboxylic acids having 4 to 12 carbon atoms are preferred.

These dicarboxylic acids may be used alone or in combination of two or more thereof.

—Trivalent or Higher Acid or Trihydric or Higher Alcohol—

The trivalent or higher acid or trihydric or higher alcohol is not particularly limited and may be appropriately selected depending on the intended purpose. Examples thereof include glycerin, trimethylolethane, trimethylolpropane (TMP), pentaerythritol, sorbitol, dipentaerythritol, trimellitic acid (TMA), and pyromellitic acid.

Among them, trivalent acids or trihydric alcohols are preferred. These trivalent acids or trihydric alcohols may be used alone or in combination of two or more thereof.

When the non-crystalline polyester resin contains the trivalent or higher acid(s) or trihydric or higher alcohol(s) as a constituent component, the non-crystalline polyester resin exhibits rubber-like elasticity and the obtained toner is more excellent in blocking resistance. In addition, since the non-crystalline polyester resin can exhibit such rubber-like elasticity with retaining high thermal deformability of the resin in a fixable temperature range, so that the obtained toner is more excellent in low temperature fixing ability and blocking resistance, trivalent acids or trihydric alcohols are preferred.

—Polyester Resin Containing Urethane Bond and Urea Bond—

The polyester resin containing a urethane bond and a urea bond is not particularly limited and may be appropriately selected depending on the intended purpose. Examples thereof include a reaction product formed between a polyester resin containing an isocyanate group (hereinafter may be referred to as "prepolymer") and a curing agent reactive with the isocyanate group of the prepolymer (e.g., an active hydrogen group-containing compound).

Examples of the polyester resin containing an isocyanate group include a reaction product formed between a polyester resin containing an active hydrogen group and a polyisocyanate.

—Polyisocyanate—

The polyisocyanate is not particularly limited and may be appropriately selected depending on the intended purpose. Examples thereof include diisocyanate, and trivalent or higher isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is not particularly limited and may be appropriately selected depending on the intended purpose. Examples thereof include $\alpha,\alpha,\alpha',\alpha'$-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

—Curing Agent—

The curing agent is not particularly limited and may be appropriately selected depending on the intended purpose so long as it can react with the prepolymer. Examples thereof include active hydrogen group-containing compounds.

—Active Hydrogen Group-Containing Compound—

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is not particularly limited and may be appropriately selected depending on the intended purpose, but it is preferably selected from amines, as the amines can form a urea bond.

The amines are not particularly limited and may be appropriately selected depending on the intended purpose. Examples thereof include diamine, trivalent or higher amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylene diamine, diethyl toluene diamine, and 4,4'-diaminodiphenyl methane. The alicyclic diamine is not particularly limited and may be appropriately selected depending on the intended purpose. Examples thereof include 4,4'-diamino-3,3'-dimethyldicyclohexyl methane, diaminocyclohexane, and isophorone diamine. The aliphatic diamine is not particularly limited and may be appropriately selected depending on the intended purpose. Examples thereof include ethylene diamine, tetramethylene diamine, and hexamethylene diamine.

The trivalent or higher amine is not particularly limited and may be appropriately selected depending on the intended purpose. Examples thereof include diethylene triamine, and triethylene tetramine.

The amino alcohol is not particularly limited and may be appropriately selected depending on the intended purpose. Examples thereof include ethanol amine, and hydroxyethyl aniline.

The aminomercaptan is not particularly limited and may be appropriately selected depending on the intended purpose. Examples thereof include aminoethyl mercaptan, and aminopropyl mercaptan.

The amino acid is not particularly limited and may be appropriately selected depending on the intended purpose. Examples thereof include aminopropionic acid, and aminocaproic acid.

The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

A molecular structure of the non-crystalline polyester resin can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin is not particularly limited and may be appropriately selected depending on the intended purpose, but it is preferably 5 parts by mass to 25 parts by mass, more preferably 10 parts by mass to 20 parts by mass, relative to 100 parts by mass of the toner. When the amount thereof is smaller than 5 parts by mass, low temperature fixing ability, and hot offset resistance of a resulting toner may be impaired. When the amount thereof is greater than 25 parts by mass, heat resistant storage stability of the toner may be impaired, and glossiness of an image obtained after fixing may reduce. When the amount thereof is within the aforementioned more preferable range, it is advantageous because all of the low temperature fixing ability, hot offset resistance, and heat resistant storage stability excel.

<Non-Crystalline Polyester Resin B>

The non-crystalline polyester resin B is not particularly limited and may be appropriately selected depending on the intended purpose so long as it has a glass transition temperature of 40° C. to 80° C.

The non-crystalline polyester resin B is preferably a linear polyester resin.

The non-crystalline polyester resin B is preferably an unmodified polyester resin. The unmodified polyester resin refers to a polyester resin that is obtained using a polyhydric alcohol and a polyvalent carboxylic acid or a derivative thereof such as a polyvalent carboxylic acid anhydride or a polyvalent carboxylic acid ester, and that is not modified with an isocyanate compound or the like.

Examples of the polyhydric alcohol include diols.

Examples of the diol include adducts of bisphenol A with alkylen (C2 to C3) oxides (average addition mole number: 1 to 10) such as polyoxypropylene(2.2)-2,2-bis(4-hydroxyphenyl)propane and polyoxyethylene(2.2)-2,2-bis(4-hydroxyphenyl)propane; hydrogenerated bisphenol A and adducts of hydrogenerated bisphenol A with alkylen (C2 to C3) oxides (average addition mole number: 1 to 10); and ethylene glycol and propylene glycol.

These may be used alone or in combination of two or more thereof.

Examples of the polyvalent carboxylic acid include dicarboxylic acids.

Examples of the dicarboxylic acid include phthalic acid, isophthalic acid, terephthalic acid, fumaric acid, adipic acid, and maleic acid; and succinic acid having, as a substituent, an alkyl group having 1 to 20 carbon atoms or an alkenyl group having 1 to 20 carbon atoms, such as dodecenyl succinic acid and octyl succinic acid.

These may be used alone or in combination of two or more thereof.

Also, in order to adjust the acid value or hydroxyl value, the non-crystalline polyester resin B may contain a trivalent or higher carboxylic acid, a trihydric or higher alcohol, or both at the end of its resin chain.

Examples of the trivalent or higher carboxylic acid include trimellitic acid (TMA), pyromellitic acid, and acid anhydrides thereof.

Examples of the trihydric or higher alcohol include glycerin, pentaerythritol, and trimethylpropane (TMP).

A molecular weight of the non-crystalline polyester resin B is not particularly limited and may be appropriately selected depending on the intended purpose. When the molecular weight thereof is too low, the obtained toner may be poor in heat resistant storage stability and durability to stress such as stirring in a developing device. When the molecular weight thereof is too high, the obtained toner may be increased in viscoelasticity upon melting to be poor in low temperature fixing ability. Hence, in GPC (gel permeation chromatography), the non-crystalline polyester resin B preferably has a weight average molecular weight (Mw) of 3,000 to 10,000, and also has a number average molecular weight (Mn) of 1,000 to 4,000. A ratio Mw/Mn is preferably 1.0 to 4.0.

The weight average molecular weight (Mw) of the non-crystalline polyester resin B is more preferably 4,000 to 7,000. The number average molecular weight (Mn) thereof is more preferably 1,500 to 3,000. The ratio Mw/Mn is more preferably 1.0 to 3.5.

An acid value of the non-crystalline polyester resin B is not particularly limited and may be appropriately selected depending on the intended purpose, but it is preferably 1 mgKOH/g to 50 mgKOH/g, more preferably 5 mgKOH/g to 30 mgKOH/g. When the acid value thereof is 1 mgKOH/g or more, the obtained toner will be negatively chargeable more easily and be better in affinity to paper upon being fixed thereon, and as a result can be improved in low temperature fixing ability. When the acid value thereof is more than 50 mgKOH/g, the obtained toner may be degraded in charging stability, especially charging stability to environmental changes.

The hydroxyl value of the non-crystalline polyester resin B is not particularly limited and may be appropriately selected depending on the intended purpose, but it is preferably 5 mgKOH/g or more.

A glass transition temperature (Tg) of the non-crystalline polyester resin B is preferably 40° C. to 80° C., more preferably 50° C. to 70° C. When the glass transition temperature thereof is lower than 40° C., the obtained toner may be poor in heat resistant storage stability and durability to stress such as stirring in a developing device, and also may be degraded in filming resistance. When the glass transition temperature thereof is higher than 80° C., the obtained toner cannot sufficiently deform with heating and pressing upon fixing, potentially leading to insufficient low temperature fixing ability.

A molecular structure of the non-crystalline polyester resin B can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin B is not particularly limited and may be appropriately selected depending on the intended purpose, but it is preferably 50 parts by mass to 90 parts by mass relative to 100 parts by mass of the toner, more preferably 60 parts by mass to 80 parts by mass relative to 100 parts by mass of the toner. When the amount of the non-crystalline polyester resin B is less than 50 parts by mass, the pigment and the releasing agent in the toner will become degraded in dispersibility, potentially easily causing fogging on images and formation of abnormal images. When the amount of the non-crystalline polyester resin B is more than 90 parts by mass, the amounts of the crystalline polyester resin C and the non-crystalline polyester resin A will become small and hence the obtained toner may be degraded in low temperature fixing ability. The amount of the non-crystalline polyester resin B falling within the above more preferable range is advantageous since the obtained toner is excellent in all of high image quality and low temperature fixing ability.

<Crystalline Polyester Resin C>

The crystalline polyester resin C exhibits thermofusion characteristics in which viscosity is drastically decreases at temperature around fixing onset temperature, as the crystalline polyester resin C has high crystallinity. By using the crystalline polyester resin C having the aforementioned characteristics together with the non-crystalline polyester resin B in the toner, the heat resistance storage stability of the toner is excellent up to the melt onset temperature owing to crystallinity, and the toner drastically decreases its viscosity (sharp melt property) at the melt onset temperature because of melting of the crystalline polyester resin C. Along with the drastic decrease in viscosity as a result of fusion, the crystalline polyester resin C is melt together with the non-crystalline polyester resin B, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin C is obtained from polyhydric alcohol and polyvalent carboxylic acid or a derivative thereof such as a polyvalent carboxylic acid anhydride or a polyvalent carboxylic acid ester.

Note that, in the present invention, the crystalline polyester resin C is one obtained from polyhydric alcohol and polyvalent carboxylic acid or a derivative thereof such as a polyvalent carboxylic acid anhydride or a polyvalent carboxylic acid ester, as described above. A resin obtained by modifying a polyester resin, for example, the aforementioned prepolymer and a resin obtained through cross-link and/or chain elongation reaction of the prepolymer do not belong to the crystalline polyester resin C.

—Polyhydric Alcohol—

The polyhydric alcohol is not particularly limited and may be appropriately selected depending on the intended purpose. Examples thereof include diol, and trihydric or higher alcohol.

Examples of the diol include saturated aliphatic diol. Examples of the saturated aliphatic diol include linear chain saturated aliphatic diol, and branched-chain saturated aliphatic diol. Among them, linear chain saturated aliphatic diol is preferable, and C2-C12 linear chain saturated aliphatic diol is more preferable. When the saturated aliphatic diol has a branched-chain structure, crystallinity of the crystalline polyester resin C may be low, which may lower the melting point. When the number of carbon atoms in the saturated aliphatic diol is greater than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin, and give excellent sharp melt properties.

Examples of the trihydric or higher alcohol include glycerin, trimethylol ethane, trimethylolpropane (TMP), and pentaerythritol.

These may be used alone or in combination of two or more thereof.

—Polyvalent Carboxylic Acid—

The polyvalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the polyvalent carboxylic acid may contain, other than the saturated aliphatic dicarboxylic acid or aromatic dicarboxylic acid, dicarboxylic acid containing a sulfonic acid group. Further, the polyvalent carboxylic acid may contain, other than the saturated aliphatic dicarboxylic acid or aromatic dicarboxylic acid, dicarboxylic acid having a double bond.

These may be used alone or in combination of two or more thereof.

The crystalline polyester resin C is preferably composed of a linear chain saturated aliphatic dicarboxylic acid having 4 to 12 carbon atoms and a linear chain saturated aliphatic diol having 2 to 12 carbon atoms. Specifically, the crystalline polyester resin C preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin C is not particularly limited and may be appropriately selected depending on the intended purpose, but it is preferably 60° C. to 80° C. When the melting point thereof is lower than 60° C., the crystalline polyester resin tends to be melted at low temperature, which may impair heat resistant storage stability of the toner. When the melting point thereof is higher than 80° C., melting of the crystalline polyester resin C with heat applied during fixing may be insufficient, which may impair low temperature fixing ability of the toner.

A molecular weight of the crystalline polyester resin C is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin C preferably has the weight average molecular weight (Mw) of 20,000 to 30,000, number average molecular weight (Mn) of 5,000 to 10,000, and Mw/Mn of 1.0 to 10, measured by GPC. When the weight average molecular weight thereof is lower than 20,000, residual oligomers may make the obtained toner insufficient in heat resistant storage stability and high-temperature, high-humidity storage stability. When the weight average molecular weight thereof is higher than 30,000, the obtained toner may be degraded in low temperature fixing ability.

An acid value of the crystalline polyester resin C is not particularly limited and may be appropriately selected depending on the intended purpose, but it is preferably 5 mgKOH/g or higher, more preferably 10 mgKOH/g or higher for achieving the desired low temperature fixing ability in view of affinity between paper and the resin. Meanwhile, the acid value thereof is preferably 45 mgKOH/g or lower for the purpose of improving hot offset resistance.

A hydroxyl value of the crystalline polyester resin C is not particularly limited and may be appropriately selected depending on the intended purpose, but it is preferably 0 mgKOH/g to 50 mgKOH/g, more preferably 5 mgKOH/g to 50 mgKOH/g, for achieving the desired low temperature fixing ability and excellent charging properties.

A molecular structure of the crystalline polyester resin C can be confirmed by solution-state or solid-state NMR, X-ray diffraction, GC/MS, LC/MS, or IR spectroscopy. Simple methods thereof include a method for detecting, as the crystalline polyester resin C, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin C is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin C does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

<Other Components>

Examples of other components include a releasing agent, colorant, charge controlling agent, external additive, a flow improving agent, a cleaning improving agent, and a magnetic material.

—Releasing Agent—

The releasing agent is appropriately selected from those known in the art without any limitation.

Examples of wax serving as the releasing agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

Further, other examples of the releasing agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax, is preferable.

A melting point of the releasing agent is not particularly limited and may be appropriately selected depending on the intended purpose, but it is preferably 60° C. to 80° C. When the melting point thereof is lower than 60° C., the releasing agent tends to melt at low temperature, which may impair heat resistant storage stability. When the melting point thereof is higher than 80° C., the releasing agent is not sufficiently melted to thereby cause fixing offset even in the case where the resin is melted and is in the fixing temperature range, which may cause defects in an image.

An amount of the releasing agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is smaller than 2 parts by mass, a resulting toner may have insufficient hot offset resistance, and low temperature fixing ability during fixing. When the amount thereof is greater than 10 parts by mass, a resulting toner may have insufficient heat resistant storage stability, and tends to cause fogging in an image. When the amount thereof is within the aforementioned more preferable range, it is advantageous because image quality and fixing stability can be improved.

—Colorant—

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. Examples of the binder resin kneaded in the production of, or together with the master batch include, other than the aforementioned non-crystalline polyester resin B, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate-copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used independently, or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

—Charge Controlling Agent—

The charge controlling agent is not particularly limited and may be appropriately selected depending on the intended purpose.

Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all products are of ORIENT CHEMICAL INDUSTRIES CO., LTD); quaternary ammonium salt molybdenum complex TP-302 and TP-415 (all products are of Hodogaya Chemical Co., Ltd.); LRA-901; boron complex LR-147 (product of Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is greater than 10 parts by mass, the charging ability of the toner becomes excessive, which may reduce the effect of the charge controlling agent, increase electrostatic force to a developing roller, leading to low flowability of the developer, or low image density of the resulting image. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—External Additive—

As for the external additive, other than oxide particles, a combination of inorganic particles and hydrophobic-treated inorganic particles can be used. The average primary particle diameter of the hydrophobic-treated particles is preferably 1 nm to 100 nm. More preferred are 5 nm to 70 nm of the inorganic particles.

Moreover, it is preferred that the external additive contain at least one type of hydrophobic-treated inorganic particles having the average primary particle diameter of 20 nm or smaller, and at least one type of inorganic particles having the average primary particle diameter of 30 nm or greater. Moreover, the external additive preferably has the BET specific surface area of 20 $m^2/g$ to 500 $m^2/g$.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all products are of Nippon Aerosil Co., Ltd.). Examples of the titania particles include P-25 (product of Nippon Aerosil Co., Ltd.); STT-30, STT-65C-S(both products are of Titan Kogyo, Ltd.); TAF-140 (product of Fuji Titanium Industry Co., Ltd.); and MT-150W, MT-500B, MT-600B, MT-150A (all products are of TAYCA CORPORATION).

Examples of the hydrophobic treated titanium oxide particles include: T-805 (product of Nippon Aerosil Co., Ltd.); STT-30A, STT-65S-S(both products are of Titan Kogyo, Ltd.); TAF-500T, TAF-1500T (both products are of Fuji Titanium Industry Co., Ltd.); MT-100S, MT-100T (both products are of TAYCA CORPORATION); and IT-S(product of ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or smaller, more preferably 3 nm to 70 nm. When it is smaller than the aforementioned range, the inorganic particles are embedded in the toner particles, and therefore the function of the inorganic particles may not be effectively exhibited. When the average particle diameter thereof is greater than the aforementioned range, the inorganic particles may unevenly damage a surface of a photoconductor, and hence not preferable.

—Flowability Improving Agent—

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

—Cleanability Improving Agent—

The cleanability improving agent is not particularly limited and may be appropriately selected depending on the intended purpose so long as it can be added to the toner for the purpose of removing the developer remained on a photoconductor or primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

The toner preferably has a glass transition temperature (Tg1st) of 20° C. to 50° C., where the glass transition temperature (Tg1st) is measured in first heating in differential scanning calorimetry (DSC).

If the Tg of a conventional toner is lowered to be about 50° C. or lower, the conventional toner tends to cause aggregation of toner particles influenced by temperature variations during transportation or storage of the toner in summer or in a tropical region. As a result, adherence of the toner arises in a toner bottle, or within a developing unit. Moreover, supply failures due to clogging of the toner in the toner bottle, and formation of defected images due to toner adherence are likely to occur.

The toner of the present invention has lower Tg than that of a conventional toner. However, the non-crystalline polyester resin A, which is a low Tg component in the toner, has a non-linear chain structure, and therefore the toner of the present invention can maintain heat resistant storage stability. Especially in the case where the non-crystalline polyester resin A has a urethane bond or urea bond having high cohesive force, an effect of maintaining heat resistant storage stability becomes significant.

When the Tg1st of the toner is lower than 20° C., the toner may have poor heat resistant storage stability, may cause blocking within a developing unit, and may cause filming on a photoconductor. When the Tg1st thereof is higher than 50° C., the toner may have poor low temperature fixing ability.

A difference (Tg1st−Tg2nd) between the glass transition temperature (Tg1nd) of the toner measured with the first heating in differential scanning calorimetry (DSC) and the glass transition temperature (Tg2nd) of the toner measured with the second heating in DSC is appropriately selected depending on the intended purpose without any limitation, but it is preferably 10° C. or more. The upper limit of the difference is appropriately selected depending on the intended purpose without any limitation, but it is preferably 50° C. or less.

When the difference thereof is 10° C. or more, it is advantageous because the toner has excellent low temperature fixing ability. The difference thereof being 10° C. or more means that the crystalline polyester resin C, the non-crystalline polyester resin A and the non-crystalline polyester resin B, which are present in a non-compatible state before heating (before the first heating), become in a compatible state after heating (after the first heating). Note that, the compatible state after heating does not necessarily mean that these resins are in the state where they are completely compatible to each other.

The melting point of the toner is not particularly limited and may be appropriately selected depending on the intended purpose, but it is preferably 60° C. to 80° C.

The volume average particle diameter of the toner is not particularly limited and may be appropriately selected depending on the intended purpose, but it is preferably 3 μm to 7 μm. Moreover, a ratio of the volume average particle diameter to the number average particle diameter is preferably 1.2 or less. Further, the toner preferably contains toner particles having the volume average particle diameter of 2 μm or smaller, in an amount of 1% by number to 10% by number.

<Calculation Methods and Analysis Methods of Various Properties of Toner and Constituent Component of Toner>

The Tg, acid value, hydroxyl value, molecular weight, and melting point of the non-crystalline polyester resin A, the non-crystalline polyester resin B, and the crystalline polyester resin C, and the releasing agent may be each measured. Alternatively, each component may be separated from an actual toner by gel permeation chromatography (GPC) or the like, and separated each component may be subjected to the analysis methods described later, to thereby calculate Tg, molecular weight, melting point, and mass ratio of a constituent component.

Separation of each component by GPC can be performed, for example, by the following method.

In GPC using tetrahydrofuran (THF) as a mobile phase, an eluate is subjected to fractionation by means of a fraction collector, a fraction corresponding to a part of a desired molecular weight is collected from a total area of an elution curve.

The collected eluates are concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative or quantitative analysis by high performance liquid chromatography (HPLC). In this case, it is preferable to previously confirm compatibility with values obtained by $^{1}$H-NMR. If there are differences between the values obtained by $^{1}$H-NMR and the values obtained by the other methods, it is preferable to confirm a conversion chart about the differences.

Note that, in the case where the method for producing a toner produces toner base particles by generating the non-crystalline polyester resin A through a chain-elongation reaction and/or crosslink reaction of the non-linear chain reactive precursor (prepolymer) and the curing agent, the polyester resin may be separated from an actual toner by GPC or the like, to thereby determine Tg thereof. Alternatively, a non-crystalline polyester resin A is separately generated through a chain-elongation reaction and/or crosslink reaction of the non-linear chain reactive precursor and the curing agent, and Tg may be measured on the synthesized non-crystalline polyester resin A.

<<Separation Unit for Toner Constituent Components>>

An example of a separation unit for each component during an analysis of the toner will be specifically explained hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, product of JEOL Ltd.) by performing multiplication 128 times at temperature of 23° C. to 25° C.

The monomer compositions and the compositional ratios of the non-crystalline polyester resin A, the non-crystalline polyester resin B, the crystalline polyester resin C, and the like contained in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (TMA) (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide (for four hydrogen atoms)

Around 1.6 ppm: derived from a methyl group of bisphenol A (for 6 hydrogen atoms).

From these results, for example, the extracted product collected in the fraction in which the non-crystalline polyester resin occupies 90% or more in the peak integral ratio in the spectrum can be treated as the non-crystalline polyester resin.

Similarly, the extracted product collected in the fraction in which the non-crystalline polyester resin B occupies 90% or more in the peak integral ratio in the spectrum can be treated as the non-crystalline polyester resin B. The extracted product collected in the fraction in which the crystalline polyester resin C occupies 90% or more in the peak integral ratio in the spectrum can be treated as the crystalline polyester resin C.

<<Measurement Methods of Hydroxyl Value and Acid Value>>

The hydroxyl group value can be measured with a method compliant with JIS K0070-1966.

Specifically, first, a sample is precisely weighed with a measuring flask to be 0.5 g, and an acetylating reagent (5 mL) is added thereto. Then, the resultant is heated for 1 to 2 hours in a warm bath of 100±5° C., and the flask is taken out from the warm bath and left to be cooled. Then, water is added to the flask, and the flask is shaken to decompose acetic acid anhydride. Then, in order to completely decompose acetic acid anhydride, the flask is again heated for 10 minutes or longer in a warm bath and left to be cooled. Then, the wall of the flask is washed well with an organic solvent.

Then, with a potential difference automatic titrator DL-53 TITRATOR (product of IVMettler Toledo International Inc.) and an electrode DG113-SC (product of Mettler Toledo International Inc), the hydroxyl group value is measured at 23° C., and analyzed with an analyzing software program LABX LIGHT VERSION 1.00.000.

For calibration of the instrument, a mixture solvent of toluene (120 mL) and ethanol (30 mL) is used.

At this time, measuring conditions are as follows.

[Measurement Conditions]

| Stir | |
|---|---|
| Speed [%] 25<br>Time [s] 15 | |
| EQP titration | |
| Titrant/Sensor<br>Titrant CH3ONa<br>Concentration [mol/L] 0.1<br>Sensor DG115<br>Unit of measurement mV<br>Predispensing to volume<br>Volume [mL] 1.0<br>Wait time [s] 0 | |
| Titrant addition | Dynamic |
| dE (set) [mV] | 8.0 |
| dV (min) [mL] | 0.03 |
| dV (max) [mL] | 0.5 |
| Measure mode | Equilibrium controlled |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs<br>n = 1 | Yes |
| comb. termination conditions | No |
| Evaluation | |
| Procedure | Standard |
| Potential1 | No |
| Potential2 | No |
| Stop for reevaluation | No |

The acid value is measured according to the method of JIS K0070-1992.

Specifically, first, 0.5 g of a sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator DL-53 (product of Mettler-Toledo K.K.) and an electrode DG113-SC (product of Mettler-Toledo K.K.) are used to measure the acid value at 23° C. The measurements are analyzed with analysis software LabX Light Version 1.00.000. The calibration for this apparatus is performed using a solvent mixture of toluene (120 mL) and ethanol (30 mL).

The measurement conditions are the same as those set for measuring the hydroxyl value.

The acid value can be measured in the above-described manner. Specifically, the sample solution is titrated with a pre-standardized 0.1N potassium hydroxide/alcohol solution and then the acid value is calculated from the titer using the equation: acid value (mgKOH/g)=titer (mL)×N×56.1 (mg/mL)/sample (g), where N is a factor of 0.1N potassium hydroxide/alcohol solution.

<<Measurement Methods of Melting Point and Glass Transition Temperature (Tg)>>

In the present invention, a melting point and a glass transition temperature (Tg) can be measured, for example, by means of a differential scanning calorimeter (DSC) system (Q-200, product of TA Instruments Japan Inc.).

Specifically, a melting point and glass transition temperature of a sample are measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by means of a differential scanning calorimeter (Q-200, product of TA Instruments Japan Inc.).

The DSC curve for the first heating is selected from the obtained DSC curve by means of an analysis program stored in the Q-200 system, to thereby determine glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Moreover, in the present specification, the endothermic peak top temperatures and glass transition temperatures of the non-crystalline polyester resin A, the non-crystalline polyester resin B, the crystalline polyester resin C, and other constituent components, such as the releasing agent, for the second heating are regarded as melting point and Tg of each sample, unless otherwise stated.

<<Method for Measuring Particle Size Distribution>>

The volume average particle diameter (D4) and number average particle diameter (Dn) of the toner and the ratio thereof (D4/Dn) can be measured, for example, by means of Coulter Counter TA-II or Coulter Multisizer II (both products are of Beckman Coulter, Inc.). In the present invention, Coulter Multisizer II was used. The measurement method will be explained below.

First, 0.1 mL to 5 mL of a surfactant (preferably alkyl benzene sulfonate (nonionic surfactant)) was added as a dispersant to 100 mL to 150 mL of an electrolyte. Note that, the electrolyte is an about 1% by mass aqueous solution prepared by using a primary sodium chloride, and for example, ISOTON-II (of Beckman Coulter, Inc.) is used as the electrolyte. Next, to the resulting mixture, 2 mg to 20 mg of a sample is added and suspended, and the mixture is dispersed by means of an ultrasonic wave disperser for about 1 minute to about 3 minutes. The volume and number of the toner particles or toner are measured from the obtained dispersion liquid using the aforementioned measuring device with an aperture of 100 m, and then the volume distribution and number distribution of the toner are calculated. From the obtained distributions, the volume average particle diameter (D4), and number average particle diameter (Dn) of the toner can be determined.

Note that, as a channel, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement are particles having the diameters of 2.00 μm or larger, but smaller than 40.30 μm.

<<Measurement of Molecular Weight>>

A molecular weight of each constituent component of a toner can be measured, for example, by the following method.

Gel permeation chromatography (GPC) measuring device: GPC-8220GPC (product of TOSOH CORPORATION)

Column: TSKgel SuperHZM-H 15 cm, three connected columns (product of TOSOH CORPORATION)

Temperature: 40° C.

Solvent: THF

Flow rate: 0.35 mL/min

Sample: 100 L of a 0.15% by mass sample to be supplied

As for the pretreatment of the sample, the sample is dissolved in tetrahydrofuran (THF) (containing a stabilizer, product of Wako Chemical Industries, Ltd.) to give a concentration of 0.15% by mass, the resulting solution is then filtered through a filter having a pore size of 0.2 μm, and the filtrate from the filtration is used as a sample. The measurement is performed by supplying 100 μL of the tetrahydrofuran (THF) sample solution. For the measurement of the molecular weight of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

<Production Method of Toner>

A production method of the toner is not particularly limited and may be appropriately selected depending on the intended purpose, but the toner is preferably granulated by dispersing, in an aqueous medium, an oil phase containing the non-crystalline polyester resin A, the non-crystalline polyester resin B, and the crystalline polyester resin C, and if necessary, further containing the releasing agent and the colorant.

Also, the toner is more preferably granulated by dispersing, in an aqueous medium, an oil phase containing the non-linear chain reactive precursor (the prepolymer), the non-crystalline polyester resin B, and the crystalline polyester resin C, and if necessary, further containing the curing agent, the releasing agent, the colorant, etc.

As one example of such a production method of the toner, a conventionally dissolution suspension method is listed.

As one example of the production method of the toner, a method for forming toner base particles while forming the non-crystalline polyester resin A through a chain-elongation reaction and/or cross-link reaction between the non-linear chain reactive precursor and the curing agent will be described hereinafter. In such a method, a preparation of an aqueous medium, preparation of an oil phase containing a toner material, emulsification and/or dispersion of the toner material, and removal of an organic solvent are carried out.

—Preparation of Aqueous Medium (Aqueous Phase)—

The preparation of the aqueous phase can be carried out, for example, by dispersing resin particles in an aqueous medium. An amount of the resin particles in the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used independently, or in combination.

Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

The oil phase containing the toner materials can be prepared by dissolving or dispersing, in an organic solvent, toner materials containing at least the non-linear chain reactive precursor, the non-crystalline polyester resin B, and the crystalline polyester resin C, and if necessary, further containing the curing agent, the releasing agent, the colorant, etc.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

—Emulsification or Dispersion—

The emulsification or dispersion of the toner materials can be carried out by dispersing the oil phase containing the toner materials in the aqueous medium. In the course of the emulsification or dispersion of the toner material, the curing agent and the non-linear chain reactive precursor are allowed to carry out a chain-elongation reaction or cross-link reaction, to thereby form the non-crystalline polyester resin A.

The non-crystalline polyester resin A can be formed by the following methods (1) to (3), for example.

(1) A method of forming the non-crystalline polyester resin A by emulsifying or dispersing, in an aqueous medium, an oil phase containing the non-linear chain reactive precursor and the curing agent, and allowing the non-linear chain reactive precursor and the curing agent to undergo extending reaction and/or crosslinking reaction in the aqueous medium.

(2) A method of forming the non-crystalline polyester resin A by emulsifying or dispersing an oil phase containing the non-linear chain reactive precursor in an aqueous medium to which the curing agent has been added in advance, and allowing the non-linear chain reactive precursor and the curing agent to undergo extending reaction and/or crosslinking reaction in the aqueous medium.

(3) A method of forming the non-crystalline polyester resin A by emulsifying or dispersing, in an aqueous medium, an oil phase containing the non-linear chain reactive precursor, adding the curing agent to the aqueous medium, and allowing the non-linear chain reactive precursor and the curing agent to undergo extending reaction and/or crosslinking reaction in the aqueous medium from the interfaces between particles.

Note that, when the non-linear chain reactive precursor and the curing agent are allowed to undergo extending reaction and/or crosslinking reaction from the interfaces between particles, the non-crystalline polyester resin A is preferentially formed on the surfaces of the produced toner particles, so that it is possible to provide a gradient of concentration of the non-crystalline polyester resin A in the toner particles.

The reaction conditions (e.g., the reaction time and reaction temperature) for generating the non-crystalline polyester resin A are not particularly limited and may be appropriately selected depending on a combination of the curing agent and the non-linear chain reactive precursor.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming a dispersion liquid containing the non-linear chain reactive precursor in the aqueous medium is not particularly limited and may be appropriately selected depending on the intended purpose. Examples thereof include a method in which an oil phase, which has been prepared by dissolving and/or dispersing a toner material in a solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid.

These may be used alone or in combination of two or more thereof.

Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters.

Among them, those having a fluoroalkyl group are preferable.

A catalyst can be used in the extending reaction and/or crosslinking reaction for forming the non-crystalline polyester resin A.

The catalyst is not particularly limited and may be appropriately selected depending on the intended purpose. Examples thereof include dibutyltinlaurate and dioctyltinlaurate.

—Removal of Organic Solvent—

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved. A one-component developer may be adopted in the case of an image forming apparatus with a process cartridge mounted therein for the main purpose of being compact and light-weight and allowing easier maintenance.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

—Core—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearing member in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 μm to 150 μm, more preferably 40 μm to 100 μm. When the volume average particle diameter thereof is smaller than 10 μm, the proportion of fine particles in the distribution of carrier particle diameters increases, causing carrier scattering because of low magnetization per carrier particle. When the volume average particle diameter thereof is greater than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

The developer of the present invention may be suitably used in image formation by various known electrophotographies such as a magnetic one-component developing method, a non-magnetic one-component developing method, and a two-component developing method.

[Toner Accommodating Container]

A toner accommodating container of the present invention accommodates the toner of the present invention. The container thereof is not particularly limited and may be appropriately selected from known containers. Examples thereof include those having a cap and a container main body.

The size, shape, structure and material of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which the developer accommodated can be transferred to an outlet port through rotation. The material for the developer-accommodating container is not particularly limited and is preferably those from which the container main body can be formed with high dimensional accuracy. Examples thereof include polyester resins, polyethylene resins, polypropylene resins, polystyrene resins, polyvinyl chloride resins, polyacrylic acids, polycarbonate resins, ABS resins and polyacetal resins.

The above toner accommodating container has excellent handleability; i.e., is suitable for storage, transportation, and is suitably used for supply of the toner with being detachably mounted to, for example, the below-described process cartridge and image forming apparatus.

[Image Forming Method and Image Forming Apparatus]

An image forming method of the present invention preferably includes at least a developing step, a transfer step, and a fixing step, more preferably includes an electrostatic latent image forming step and a cleaning step. If necessary, the image forming method may include a charge-eliminating step, a recycling step, and a controlling step, for example.

An image forming apparatus of the present invention preferably includes at least an electrostatic latent image bearing member, an electrostatic latent image forming unit, a developing unit, a transfer unit, and a fixing unit, more preferably includes a cleaning unit, and if necessary, may include a charge-eliminating unit, a recycling unit, and a controlling unit, for example.

The image forming method of the present invention may be performed with the image forming apparatus of the present invention. The electrostatic latent image forming step may be performed with the electrostatic latent image forming apparatus. The developing step may be performed with the developing unit. The transfer step may be performed with the transfer unit. The fixing step may be performed with the fixing unit. The other steps may be performed with the other unit.

(Electrostatic Latent Image Forming Step and Electrostatic Latent Image Forming Unit)

The electrostatic latent image forming step is a step of forming an electrostatic latent image on an electrostatic latent image bearing member such as a photoconductive insulator or a photoconductor.

A material, shape, structure, size, etc. of the electrostatic latent image bearing member are not particularly limited and may be appropriately selected those known in the art. The shape thereof is preferably a drum shape.

Also, the electrostatic latent image bearing member is, for example, an inorganic photoconductor made of amorphous silicon or selenium, or an organic photoconductor made of polysilane or phthalopolymethine. Among them, an amorphous silicon photoconductor is preferred since it has a long service life.

The electrostatic latent image is formed by, for example, uniformly charging a surface of the electrostatic latent image bearing member and then imagewise exposing the charged surface to light, and can be formed with the electrostatic latent image forming unit. For example, the electrostatic latent image forming unit contains at least a charging device configured to apply voltage to a surface of the electrostatic latent image bearing member to uniformly charge the surface thereof, and a light exposing device configured to imagewise expose the charged surface of the electrostatic latent image bearing member.

The charging device is not particularly limited and may be appropriately selected depending on the intended purpose.

Examples thereof include known contact-type charging devices having, for example, an electrically conductive or semiconductive roller, brush, film and rubber blade; and non-contact-type charging devices utilizing corona discharge such as corotron and scorotron.

The exposing device is not particularly limited and may be appropriately selected depending on the purpose so long as it attains desired imagewise exposure on the surface of the electrophotographic latent image bearing member charged with the charging member. Examples thereof include various exposing devices such as a copy optical exposing device, a rod lens array exposing device, a laser optical exposing device, and a liquid crystal shutter exposing device.

In the present invention, light may be imagewise applied from the side facing the support of the electrostatic latent image bearing member.

Alternatively, the electrostatic latent image forming unit may be a unit consisting of a charging unit configured to imagewise or selectively perform charging, instead of one containing a charging unit configured to uniformly charge a surface of the electrostatic latent image bearing member and an exposing unit configured to selectively expose the charged surface thereof to form an electrostatic latent image.

(Developing Step and Developing Unit)

The developing step is a step of developing an electrostatic latent image with the toner of the present invention to form a visible image, and the visible image can be formed by a developing unit. The developing unit is not particularly limited so long as it can perform development with the toner of the present invention. Examples thereof include a developing unit including at least a developing device containing the developer of the present invention and configured to apply the toner to the electrostatic latent image in a contact or non-contact manner. Preferably, the developing unit is, for example, a developing device provided with the toner accommodating container of the present invention.

The developing device may employ a dry or wet developing process, and may be a single-color or multi-color developing device. Examples thereof include a developing device 5 containing: a stirring device for charging the toner with friction generated during stirring; and a rotatable magnetic roller. In the developing device, the toner particles of the present invention and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrostatic latent image developing member and thus, some of the toner particles forming the magnetic brushes on the magnet roller are transferred onto the surface of the electrostatic latent image developing member by the action of electrically attractive force. As a result, the electrostatic latent image is developed with the toner particles to form a toner image on the surface of the electrostatic latent image developing member. Note that, the developer to be accommodated in the developing device, which is the developer of the present invention, may be a one-component developer or a two-component developer.

(Transfer Step and Transfer Unit)

The transfer step is, for example, a step of transferring a visible image onto a recording medium, and the visible image can be transferred by a transfer unit. Here, the transfer step is preferably includes: a primary transfer step of transferring the toner images to an intermediate transfer member; and a secondary transfer step of transferring the toner images transferred onto the intermediate transfer member onto a recording medium. More preferably, the transfer step includes: a primary transfer step of transferring color toner images using two or more color toners, preferably full color toners onto an intermediate transfer member to form a composite toner image; and a secondary transfer step of transferring the composite toner image formed on the intermediate transfer member onto a recording medium.

The transfer unit preferably includes: a primary transfer unit configured to transfer toner images onto an intermediate transfer member to form a composite toner image; and a secondary transfer unit configured to transfer the composite toner image formed on the intermediate transfer member onto a recording medium. The intermediate transfer member is not particularly limited and may be appropriately selected from known transfer members depending on the intended purpose. For example, the intermediate transfer member is an endless transferring belt. The transfer unit (the primary transfer unit and the secondary transfer unit) preferably includes at least a transfer device which transfers through charging the toner images formed on the electrostatic latent image bearing member onto the recording medium. The transfer unit may have one or more transfer devices.

Examples of the transfer device include a corona transfer device employing corona discharge, a transfer belt, a transfer roller, a pressing transfer roller and an adhesive transferring device.

The recording medium is not particularly limited and may be appropriately selected from known recording medium (recording paper).

(Fixing Step and Fixing Unit)

The fixing step is a step of fixing a transfer image transferred onto the recording medium, and the transfer image can be fixed by a fixing unit. When two or more color toners are used, fixing may be performed every time each of the color toners is transferred onto a recording medium, or in a state where all of the color toners have been transferred onto a recording medium. The fixing unit is nor particularly limited and may be a known heating-pressurizing member. Examples thereof include a combination of a heat roller and a press roller, and a combination of a heat roller, a press roller and an endless belt. The heating temperature in the fixing is generally 80° C. to 200° C. Note that, known photofixing devices may be used instead of or in addition to the fixing unit depending on the intended purpose.

(Charge-Eliminating Step and Charge-Eliminating Unit)

The charge-eliminating step is a step of applying a. charge-eliminating bias to the electrostatic latent image bearing member. The charge-eliminating step can be performed by a charge-eliminating unit. The charge-eliminating unit is not particularly limited as long as it can apply a charge-eliminating bias to the electrostatic latent image bearing member. Examples thereof include a charge-eliminating lamp.

(Cleaning Step and Cleaning Unit)

The cleaning step is a step of removing the toner remaining on the electrostatic latent image bearing member. The cleaning step can be performed by a cleaning unit. The cleaning unit is not particularly limited as long as it can remove the toner remaining on the electrostatic latent image bearing member. Examples thereof include a magnetic brush cleaner, an electrostatic brush cleaner, a magnetic roller cleaner, a blade cleaner, a brush cleaner and a web cleaner.

(Recycling Step and Recycling Unit)

The recycling step is a step of recycling the toner which has been removed at the cleaning step to the developing unit. The recycling step can be performed by a recycling unit. The recycling unit is not particularly limited and may be, for example, a known conveying unit.

(Control Step and Control Unit)

The control unit is a step of controlling the operation of each of the above units. The control step can be performed by a control unit.

The control unit is not particularly limited as long as it can control the operation of each of the above units. Examples thereof include devices such as sequencer and computer.

[Image Forming Apparatus]

One example of the image forming apparatus of the present invention is illustrated in FIG. 1. An image forming apparatus 100A includes a photoconductor drum 10 serving as the electrostatic latent image bearing member, a charging roller 20 serving as the charging unit, an exposing device (not illustrated) serving as the exposing unit, developing devices 45 (K, Y, M, C) serving as the developing unit, an intermediate transfer member 50, a cleaning device 60 serving as the cleaning unit which includes a cleaning blade, and a charge-eliminating lamp 70 serving as the charge-eliminating unit.

The intermediate transfer member 50 is an endless belt, and designed so as to be movable in a direction indicated by an arrow and stretched by three rollers 51 which are disposed inside the belt. A part of the three rollers 51 also functions as a transfer bias roller which may apply a predetermined transfer bias (primary transfer bias) to the intermediate transfer member 50.

Also, a cleaning device 90 including a cleaning blade is disposed near the intermediate transfer member 50. Further, a transfer roller 80 serving as the transfer unit which can apply a transfer bias for transferring (secondary transferring) a toner image onto recording paper 95 is disposed near the intermediate transfer member 50 facing the intermediate transfer member 50.

In addition, around the intermediate transfer member 50, a corona charging device 52 for applying a charge to the toner image on the intermediate transfer member 50 is disposed between a contact portion of the photoconductor drum 10 with the intermediate transfer member 50 and a contact portion of the intermediate transfer member 50 with the recording paper 95.

The developing devices 45 for black (K), yellow (Y), magenta (M) and cyan (C) each include a developer container 42 (K, Y, M, C), a developer supply roller 43, and a developing roller 44.

In the image forming apparatus 100A, the charging roller 20 uniformly charges a surface of the photoconductor drum 10, and then the exposing device (not illustrated) image-wise-exposes the photoconductor drum 10 to light L to form an electrostatic latent image. Next, the electrostatic latent image formed on the photoconductor drum 10 is developed with a developer supplied from the developing device 45 to form a toner image. Further, the toner image is transferred (primarily transferred) onto the intermediate transfer member 50 by transfer bias applied from the roller 51. Moreover, after charged by the corona charging device 52, the toner image on the intermediate transfer member 50 is transferred (secondarily transferred) onto recording paper 95. Notably, a residual toner remaining on the photoconductor drum 10 is removed by the cleaning device 60, and the photoconductor drum 10 is once charge-eliminated by the charge-eliminating lamp 70.

Figure 2:
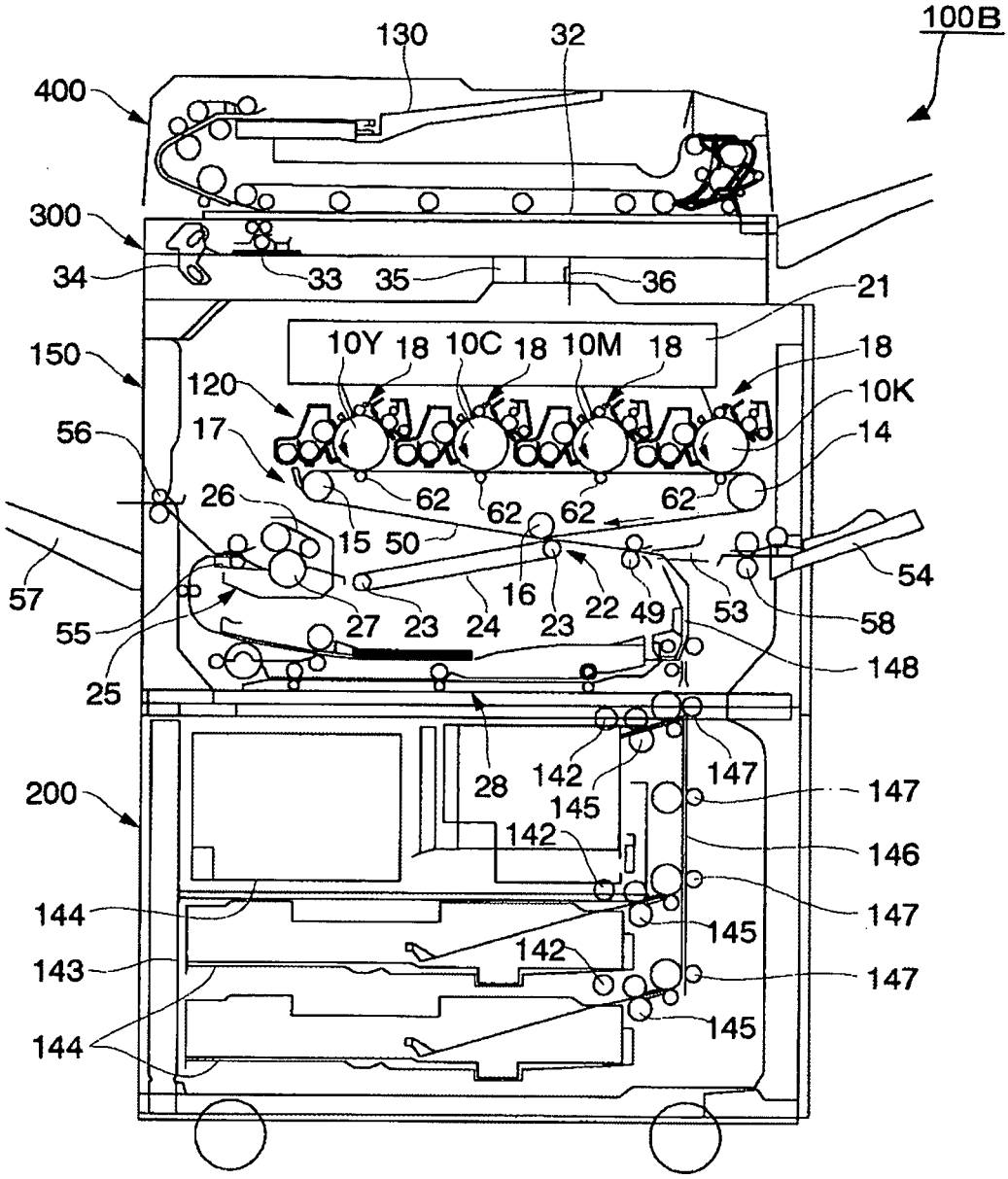
FIG. 2 is a schematic view of another example of an image forming apparatus of the present invention.

FIG. 2 illustrates another example of the image forming apparatus of the present invention. An image forming apparatus 100B is a tandem type color image forming apparatus and includes a copying device main body 150, a paper feeding table 200, a scanner 300 and an automatic document feeder (ADF) 400.

An intermediate transfer member 50 which is an endless belt is disposed at a central part of the copying device main body 150. The intermediate transfer member 50 is stretched around support rollers 14, 15 and 16 and can rotate in the arrow direction.

Near the support roller 15, a cleaning device 17 is disposed to remove a residual toner remaining on the intermediate transfer member 50. On the intermediate transfer member 50 stretched around the support rollers 14 and 15, a tandem type developing device 120 is disposed in which four image forming units 18 of yellow, cyan, magenta and black are arranged in parallel so as to face to each other along a conveying direction thereof.

Figure 3:
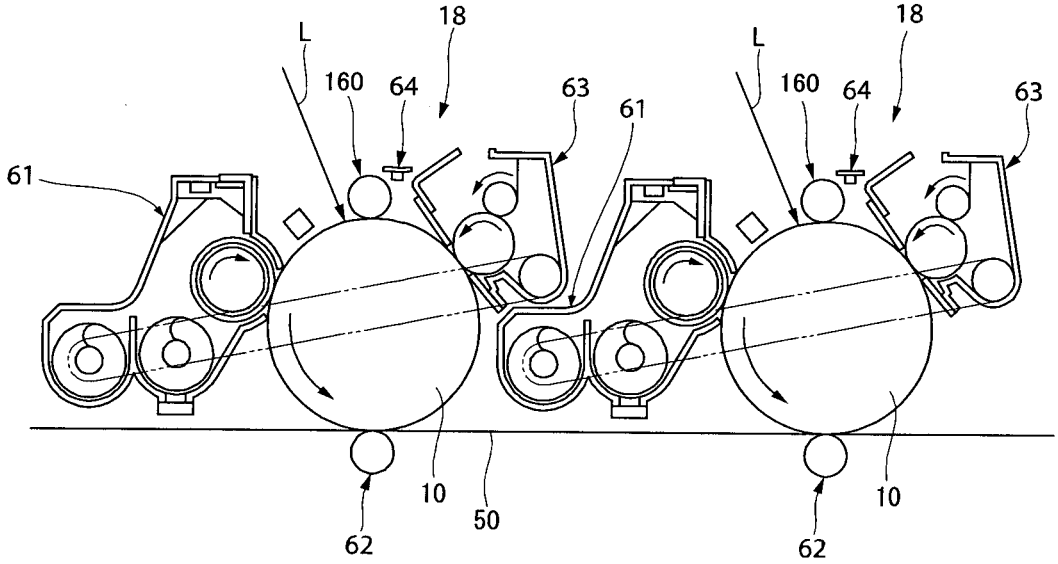
FIG. 3 is a schematic view of an image forming unit for each color in the exemplary image forming apparatus of FIG. 2.

The image forming unit 18 for each color in the tandem type developing device 120 includes: as illustrated in FIG. 3, a photoconductor drum 10; a charging roller 160 configured to uniformly charge the photoconductor drum 10; a developing device 61 configured to develop the electrostatic latent image formed on the photoconductor drum 10 with a developer for each of black (K), yellow (Y), magenta (M) and cyan (C) to form a toner image; a transfer roller 62 configured to transfer the toner image of each color onto the intermediate transfer member 50; a cleaning device 63; and a charge-eliminating device 64.

Also, in the image forming apparatus of FIG. 2, the exposing device 21 is disposed in proximity to the tandem type developing device 120. The exposing device 21 is configured to expose a photoconductor drum 10 to light to form an electrostatic latent image.

Further, a secondary transfer device 22 is disposed on a side of the intermediate transfer member 50 opposite to the side on which the tandem type developing device 120 is disposed. The secondary transfer device 22 includes a secondary transfer belt 24 which is an endless belt stretched around a pair of rollers 23, and recording paper conveyed on the secondary transfer belt 24 and the intermediate transfer member 50 may contact with each other.

A fixing device 25 is disposed in proximity to the secondary transfer device 22. The fixing device 25 includes a fixing belt 26 which is an endless belt and a press roller 27 which is disposed so as to be pressed against the fixing belt 26.

Also, a sheet inverting device 28 is disposed near the secondary transfer device 22 and the fixing device 25 for inverting the recording paper in the case of forming images on both sides of the recording paper.

Next, formation of a full-color image (color-copying) in the image forming apparatus 100B will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed. When a start button (not shown) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, a light is irradiated from a light source in the first travelling body 33, the light reflected from a surface of the document is reflected by a mirror in the second travelling body 34 and then is received by a reading sensor 36 through an imaging lens 35. Thus, the color document (color image) is read to thereby form black, yellow, magenta and cyan image information.

Further, after the electrostatic latent image for each color has been formed on the photoconductor drum 10 by the exposing device 21 based on the obtained image information of each color, the electrostatic latent image for each color is developed with a developer supplied from the tandem type developing device 120 for each color to form a toner image of each color. The formed toner images of each color are sequentially transferred (primarily transferred) on top of each other on the intermediate transfer member 50 rotated by the support rollers 14, 15 and 16, to thereby form a composite toner image on the intermediate transfer member 50.

On the paper feeding table 200, one of paper feeding rollers 142 is selectively rotated to feed a sheet of recording paper from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller 142 is rotated to feed a sheet of recording paper on a manual feed tray 54. The sheet (recording paper) is separated one by one by a separation roller 58 and is guided to a manual paper feeding path 53, and stops by colliding with the registration roller 49. Notably, the registration roller 49 is generally used while grounded, but it may also be used in a state that a bias is being applied for removing paper dust on the sheet.

Next, by rotating the registration roller 49 in accordance with the timing of the composite toner image formed on the intermediate transfer member 50, the sheet of recording paper is fed to between the intermediate transfer member 50 and the secondary transfer device 22, so that the composite toner image is transferred (secondarily transferred) onto the sheet of recording paper.

The sheet of recording paper on which the composite toner image has been transferred is conveyed by the secondary transfer device 22, and then conveyed to the fixing device 25. In the fixing device 25, the composite color image is fixed on the sheet of recording paper by the action of heat and pressure applied by the fixing belt 26 and the press roller 27. Next, the sheet of recording paper is switched by a switching claw 55, and discharged by a discharge roller 56 and stacked in a paper discharge tray 57.

Alternatively, the sheet of recording paper is switched by the switching claw 55, and is inverted by the inverting device 28 to thereby be guided to a transfer position again. After an image is formed similarly on the rear surface, the recording paper is discharged by the discharge roller 56 stacked in the paper discharge tray 57.

Notably, a residual toner remaining on the intermediate transfer member 50 after transfer of the composite toner image is removed by the cleaning device 17.

[Process Cartridge]

A process cartridge according to the present invention includes at least an electrostatic latent image bearing member, and a developing device containing the developer of the present invention, and is mounted to an image forming apparatus in a detachable manner. The process cartridge may include other process units selected from the group consisting of a charging unit, a toner image-transferring unit, and a cleaning unit.

Figure 4:
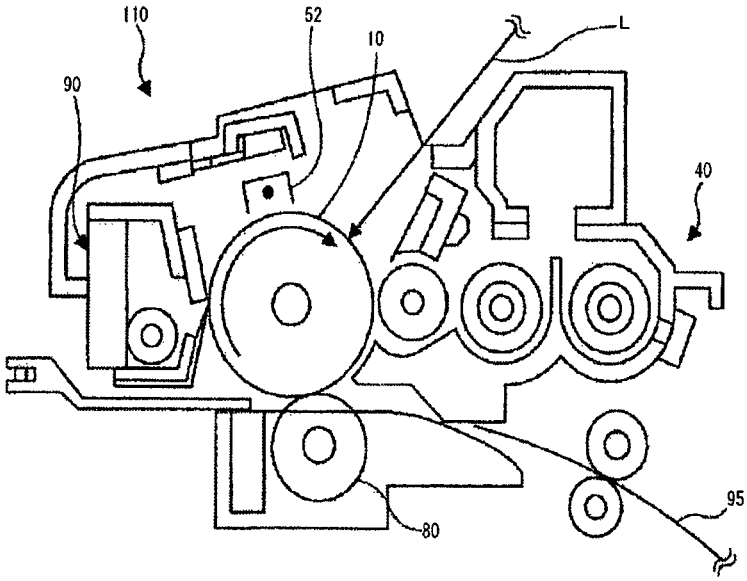
FIG. 4 is a schematic view of one example of a process cartridge of the present invention.

FIG. 4 illustrates one example of the process cartridge of the present invention. A process cartridge 110 includes a photoconductor drum 10, a corona charging device 52, a developing device 40, a transfer roller 80, and a cleaning device 90.

A process cartridge of the present invention is molded so as to be mounted to various image forming apparatuses in an attachable and detachable manner, including at least an electrostatic latent image bearing member configured to bear an electrostatic latent image thereon; and a developing unit configured to develop the electrostatic latent image borne on the electrostatic latent image bearing member with the developer of the present invention to form a toner image. Note that, the process cartridge of the present invention may further include other units, if necessary.

The developing unit includes at least a developer accommodating container that accommodates the developer of the present invention, and a developer bearing member configured to bear and transfer the developer accommodated in the developer accommodating container. Note that, the developing unit may further include, for example, a regulating member configured to regulate the thickness of the borne developer.

EXAMPLES

The present invention will be described by way of Examples below. The present invention should not be construed as being limited to the Examples. Unless otherwise specified, "part(s)" means "part(s) by mass". Unless otherwise specified, "%" means "% by mass".

Measurements in the Examples below were obtained by the methods described in the present specification. Note that, the Tg, Tm and molecular weights of the non-crystalline polyester resin A, the non-crystalline polyester resin B, and the crystalline polyester resin C and the like were measured from each resin obtained in Production Example.

Production Example 1

<Synthesis of Ketimine>

A reaction vessel to which a stirring bar and a thermometer had been set was charged with 170 parts of isophorone diamine and 75 parts of methyl ethyl ketone, and the resulting mixture was allowed to react for 5 hours at 50° C., to thereby obtain [ketimine compound 1].

The [ketimine compound 1] was found to have an amine value of 418.

(Production of Non-Crystalline Polyester Resin A)

<Synthesis of Non-Crystalline Polyester Resin A-1>

A reaction vessel equipped with a condenser, a stirrer and a nitrogen-introducing tube was charged with 97 mol % of 3-methyl-1,5-pentanediol and 3 mol % of trimethylolpropane (TMP) as alcohol components and 100 mol % of adipic acid as an acid component so that the molar ratio of OH/COOH was 1.1, together with titanium tetraisopropoxide (300 ppm relative to the resin component). Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield intermediate polyester. Next, a reaction vessel equipped with a condenser, a stirrer and a nitrogen-introducing tube was charged with the obtained intermediate polyester, and isophorone diisocyanate at a molar ratio of 2.1, and after diluted with ethyl acetate to give a 48% ethyl acetate solution, the mixture was allowed to react for 5 hours at 100° C., to thereby obtain non-linear chain polyester resin A-1 (prepolymer A-1) having a reactive group. This resin was found to have a number average molecular weight (Mn) of 3,800, a weight average molecular weight (Mw) of 17,500, and a Tg of −55° C.

<Synthesis of Non-Crystalline Polyester Resin A-2>

Non-crystalline polyester resin A-2 (prepolymer A-2) was obtained in the same manner as in <Synthesis of non-crystalline polyester resin A-1> except that the dicarboxylic acid component and the alcohol components were changed to the dicarboxylic acid component and the alcohol components shown in Tables 1-3 and 1-5. Physical properties thereof are shown in Tables 1-3 and 1-5.

<Synthesis of Non-Crystalline Polyester Resin A-3>

Non-crystalline polyester resin A-3 (prepolymer A-3) was obtained in the same manner as in <Synthesis of non-crystalline polyester resin A-1> except that the dicarboxylic acid component and the alcohol components were changed to the dicarboxylic acid component and the alcohol components shown in Table 1-3. Physical properties thereof are shown in Table 1-3.

<Synthesis of Non-Crystalline Polyester Resin A-4>

A reaction vessel equipped with a condenser, a stirrer and a nitrogen-introducing tube was charged with 100 mol % of 3-methyl-1,5-pentanediol as an alcohol component, and 40 mol % of isophthalic acid and 60 mol % of adipic acid as carboxylic acid components so that the molar ratio of hydroxyl groups to carboxyl groups, represented by OH/COOH, was 1.5 and an amount of trimellitic anhydride was 1 mol % relative to the total amount of the monomers, together with titanium tetraisopropoxide (1,000 ppm relative to the resin component).

Thereafter, the mixture was heated to 200° C. over about 4 hours, and heated to 230° C. over 2 hours, followed by carrying out a reaction until effluent water stopped. Thereafter, the resultant was allowed to further react for 5 hours under the reduced pressured of 10 mmHg to 15 mmHg, to thereby yield intermediate polyester A-4(1).

Next, a reaction vessel equipped with a condenser, a stirrer and a nitrogen-introducing tube was charged with the obtained intermediate polyester A-4(1), and isophorone diisocyanate (IPDI) at a molar ratio (isocyanate groups of IPDI/hydroxyl groups of intermediate polyester) of 2.0, and after diluted with ethyl acetate to give a 50% ethyl acetate solution, the mixture was allowed to react for 5 hours at 100° C., to thereby obtain non-crystalline polyester resin A-4 (prepolymer A-4).

Physical properties thereof are shown in Tables 1-1 and 1-5.

(Production of Non-Crystalline Polyester Resin B)

<Synthesis of Non-Crystalline Polyester Resin B-1>

A four necked flask equipped with a nitrogen-introducing tube, a drainpipe, a stirrer and a thermocouple was charged with bisphenol A ethylene oxide 2 mol adduct, bisphenol A propylene oxide 3 mol adduct, terephthalic acid, and adipic acid (ADA), so that the molar ratio of the bisphenol A propylene oxide 3 mol adduct to the bisphenol A ethylene oxide 2 mol adduct (bisphenol A propylene oxide 3 mol adduct/bisphenol A ethylene oxide 2 mol adduct) was 62/38, the molar ratio of terephthalic acid to adipic acid (terephthalic acid/adipic acid) was 93/7, and the molar ratio of hydroxyl groups to carboxyl groups, represented by OH/COOH, was 1.3. The resulting mixture was allowed to react with titanium tetraisopropoxide (500 ppm relative to the resin component) for 8 hours at 230° C. under atmospheric pressure, and was further reacted for 4 hours under the reduced pressure of 10 mmHg to 15 mmHg. Thereafter, trimellitic anhydride was added to the reaction vessel in an amount of 1 mol % relative to the entire resin component, and the resultant was allowed to react for 3 hours at 180° C., under atmospheric pressure, to thereby obtain non-crystalline polyester resin B-1. Physical properties thereof are shown in Tables 1-1 and 1-3.

<Synthesis of Non-Crystalline Polyester Resin B-2>

Non-crystalline polyester resin B-2 was obtained in the same manner as in <Synthesis of non-crystalline polyester resin B-1> except that the dicarboxylic acid component and the alcohol components were changed to the dicarboxylic acid component and the alcohol components shown in Tables 1-1 and 1-5. Physical properties thereof are shown in Tables 1-1 and 1-5.

<Synthesis of Non-Crystalline Polyester Resin B-3>

Non-crystalline polyester resin B-3 was obtained in the same manner as in <Synthesis of non-crystalline polyester resin B-1> except that the dicarboxylic acid component and the alcohol components were changed to the dicarboxylic acid component and the alcohol components shown in Tables 1-1, 1-3 and 1-5. Physical properties thereof are shown in Tables 1-1, 1-3 and 1-5.

(Production of Crystalline Polyester Resin C)

<Synthesis of Crystalline Polyester Resin C-1>

A 5 L four necked flask equipped with a nitrogen-introducing pipe, a drainpipe, a stirrer and a thermocouple was charged with sebacic acid and 1,6-hexanediol, so that the molar ratio of hydroxyl groups to carboxyl groups, represented by OH/COOH, was 0.9. The resulting mixture was allowed to react with titanium tetraisopropoxide (500 ppm relative to the resin component) for 10 hours at 180° C., and the heated to 200° C. and reacted for 3 hours, followed by further reacting for 2 hours under the pressure of 8.3 kPa, to thereby obtain crystalline polyester resin C-1. Physical properties thereof are shown in Tables 1-1 and 1-3.

<Synthesis of Crystalline Polyester Resin C-2>

Crystalline polyester resin C-2 was obtained in the same manner as in <Synthesis of crystalline polyester resin C-1> except that the dicarboxylic acid component and the alcohol components were changed to the dicarboxylic acid component and the alcohol components shown in Tables 1-1 and 1-5. Physical properties thereof are shown in Tables 1-1 and 1-5.

<Synthesis of Crystalline Polyester Resin C-3>

Crystalline polyester resin C-3 was obtained in the same manner as in <Synthesis of crystalline polyester resin C-1> except that the dicarboxylic acid component and the alcohol components were changed to the dicarboxylic acid component and the alcohol components shown in Tables 1-3 and 1-5. Physical properties thereof are shown in Tables 1-3 and 1-5.

<Synthesis of Crystalline Polyester Resin C-4>

Crystalline polyester resin C-4 was obtained in the same manner as in <Synthesis of crystalline polyester resin C-1> except that the dicarboxylic acid component and the alcohol components were changed to the dicarboxylic acid component and the alcohol components shown in Tables 1-3 and 1-5. Physical properties thereof are shown in Tables 1-3 and 1-5.

<Synthesis of Crystalline Polyester Resin C-5>

Crystalline polyester resin C-5 was obtained in the same manner as in <Synthesis of crystalline polyester resin C-1> except that the dicarboxylic acid component and the alcohol components were changed to the dicarboxylic acid component and the alcohol components shown in Table 1-5. Physical properties thereof are shown in Table 1-5.

Example 1

<Preparation of Master Batch (MB)>

Water (1,200 parts), 500 parts of carbon black (Printex 35, product of Evonik Degussa Japan Co., Ltd.) [DBP oil absorption amount=42 mL/100 mg, pH=9.5], and 500 parts of the non-crystalline polyester resin B-1 were added and mixed together by means of HENSCHEL MIXER (product of NIPPON COLE & ENGINEERING CO., LTD.), and the resulting mixture was kneaded by means of a two roll mill for 30 minutes at 150° C. The resulting kneaded product was rolled out and cooled, followed by pulverizing by a pulverizer, to thereby obtain master batch 1.

<Preparation of WAX Dispersion Liquid>

A vessel to which a stirring bar and a thermometer had been set was charged with 300 parts of paraffin wax (HNP-9, product of Nippon Seiro Co., Ltd., hydrocarbon wax, melting point: 75° C.) as the releasing agent, 150 parts of a wax dispersing agent, and 1,800 parts of ethyl acetate, followed by heating to 80° C. with mixing. The temperature was maintained at 80° C. for 5 hours, followed by cooling to 30° C. over 1 hour. The resulting mixture was dispersed by means of a bead mill (ULTRA VISCOMILL, product of AIMEX CO., Ltd.) under the conditions: a liquid feed rate of 1 kg/hr, disc circumferential velocity of 6 m/s, 0.5 mm-zirconia beads packed to 80% by volume, and 3 passes, to thereby obtain [WAX dispersion liquid 1].

<Preparation of Crystalline Polyester Resin Dispersion Liquid>

A container equipped with a stirring bar and a thermometer was charged with 308 parts of the crystalline polyester resin C-1, and 1,900 parts of ethyl acetate, and the resulting mixture was heated to 80° C. with stirring. The temperature was kept at 80° C. for 5 hours, followed by cooling to 30° C. over 1 hour. The resultant was dispersed by means of a bead mill (ULTRA VISCOMILL, product of AIMEX CO., LTD.), under the following conditions: a liquid feed rate of 1 kg/hr, disc circumferential velocity of 6 m/s, zirconia beads 0.5 mm in diameter packed to 80% by volume, and 3 passes, to thereby obtain [crystalline polyester resin dispersion liquid 1].

<Preparation of Oil Phase>

A vessel was charged with 190 parts of the [WAX dispersion liquid 1], 32 parts of [prepolymer A-1], 290 parts of the [crystalline polyester resin dispersion liquid 1], 65 parts of the [non-crystalline polyester resin B-1], 100 parts of the [master batch 1], and 0.2 parts of the [ketimine compound 1]. The resultant mixture was mixed by means of a TK Homomixer (product of PRIMIX Corporation) at 7,000 rpm for 60 minutes, to thereby obtain [oil phase 1].

<Synthesis of Organic Particle Emulsion (Particle Dispersion Liquid)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by means of LA-920 (product of HORIBA, Ltd.), and as a result, the volume average particle diameter thereof was found to be 0.14 μm. Part of the [particle dispersion liquid 1] was dried, and a resin component thereof was isolated.

<Preparation of Aqueous Phase>

Water (990 parts), 83 parts of the [particle dispersion liquid 1], 37 parts of a 48.5% aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification and Removal of Solvent>

To a container charged with the [oil phase 1], 1,200 parts of the [aqueous phase 1] was added, and the resulting mixture was mixed by means of a TK Homomixer at 8,000 rpm for 20 minutes, to thereby obtain [emulsified slurry 1].

A container equipped with a stirrer and a thermometer was charged with the [emulsified slurry 1], followed by removing the solvent therein at 30° C. for 8 hours. Thereafter, the resultant was matured at 45° C. for 4 hours, to thereby obtain [dispersion slurry 1].

<Washing and Drying>

After subjecting 100 parts of the [dispersion slurry] to filtration under the reduced pressure, the resultant was subjected twice to a series of treatments (1) to (4) described below, to thereby produce [filtration cake 1]:

(1): ion-exchanged water (100 parts) was added to the filtration cake, followed by mixing with TK Homomixer (at 12,000 rpm for 10 minutes) and then filtration;

(2): 10% aqueous sodium hydroxide solution (100 parts) was added to the filtration cake obtained in (1), followed by mixing with TK Homomixer (at 12,000 rpm for 30 minutes) and then filtration under reduced pressure;

(3): 10% by mass hydrochloric acid (100 parts) was added to the filtration cake obtained in (2), followed by mixing with TK Homomixer (at 12,000 rpm for 10 minutes) and then filtration; and (4): ion-exchanged water (300 parts) was added to the filtration cake obtained in (3), followed by mixing with TK Homomixer (at 12,000 rpm for 10 minutes) and then filtration.

The [filtration cake 1] was dried with an air-circulating drier at 45° C. for 48 hours, and then was caused to pass through a sieve with a mesh size of 75 μm, to thereby prepare [toner 1].

Compositional ratios and physical properties of the obtained toner are shown in Tables 1-1 and 1-2.

Example 2

[Toner 2] was obtained in the same manner as in Example 1 except that the non-crystalline polyester resin B-1 was changed to the non-crystalline polyester resin B-2.

Example 3

[Toner 3] was obtained in the same manner as in Example 1 except that the non-crystalline polyester resin B-1 was changed to the non-crystalline polyester resin B-3.

Example 4

[Toner 4] was obtained in the same manner as in Example 1 except that the crystalline polyester resin C-1 was changed to the crystalline polyester resin C-2.

Example 5

[Toner 5] was obtained in the same manner as in Example 1 except that the non-crystalline polyester resin A-1 was changed to the non-crystalline polyester resin A-4.

Example 6

[Toner 6] was obtained in the same manner as in Example 1 except that the non-crystalline polyester resin A-1 was changed to the non-crystalline polyester resin A-3.

Example 7

[Toner 7] was obtained in the same manner as in Example 1 except that the crystalline polyester resin C-1 was changed to the crystalline polyester resin C-3.

Example 8

[Toner 8] was obtained in the same manner as in Example 1 except that the crystalline polyester resin C-1 was changed to the crystalline polyester resin C-4.

Example 9

[Toner 9] was obtained in the same manner as in Example 1 except that the amount of the non-crystalline polyester resin B-1 was reduced and the amount of the crystalline polyester resin C-1 was increased so as to be a compositional ratio shown in Table 1-3.

Example 10

[Toner 10] was obtained in the same manner as in Example 1 except that the non-crystalline polyester resin A-1 was changed to the non-crystalline polyester resin A-2, and the non-crystalline polyester resin B-1 was changed to the non-crystalline polyester resin B-3.

Comparative Example 1

[Toner 11] was obtained in the same manner as in Example 1 except that the non-crystalline polyester resin A-1 was changed to the non-crystalline polyester resin A-2, the non-crystalline polyester resin B-1 was changed to the non-crystalline polyester resin B-4, the crystalline polyester resin C-1 was changed to the crystalline polyester resin C-2, and the compositional ratio in the toner was changed to the compositional ratio shown in Table 1-5.

Comparative Example 2

[Toner 12] was obtained in the same manner as in Example 1 except that the non-crystalline polyester resin B-1 was changed to the non-crystalline polyester resin B-2, the crystalline polyester resin C-1 was changed to the crystalline polyester resin C-4, and the compositional ratio in the toner was changed to the compositional ratio shown in Table 1-5.

Comparative Example 3

[Toner 13] was obtained in the same manner as in Example 1 except that the non-crystalline polyester resin B-1 was changed to the non-crystalline polyester resin B-3, and the crystalline polyester resin C-1 was changed to the crystalline polyester resin C-3.

Comparative Example 4

[Toner 14] was obtained in the same manner as in Example 1 except that the non-crystalline polyester resin A-1 was changed to the non-crystalline polyester resin A-2, the non-crystalline polyester resin B-1 was changed to the non-crystalline polyester resin B-2, and the crystalline polyester resin C-1 was changed to the crystalline polyester resin C-2.

Comparative Example 5

[Toner 15] was obtained in the same manner as in Example 1 except that the non-crystalline polyester resin A-1 was changed to the non-crystalline polyester resin A-4, the non-crystalline polyester resin B-1 was changed to the non-crystalline polyester resin B-4, the crystalline polyester resin C-1 was changed to the crystalline polyester resin C-5, and the compositional ratio in the toner was changed to the compositional ratio shown in Table 1-5.

<Evaluation>

Each of the obtained toners was used to prepare developers by the following method, and the following evaluation was performed on the prepared developers. The results are shown in Table 1-5.

<<Developer>>

—Production of Carrier—

To 100 parts of toluene, 100 parts of a silicone resin (organo straight silicone), 5 parts of γ-(2-aminoethyl)aminopropyltrimethoxy silane, and 10 parts of carbon black were added, and the resultant mixture was dispersed by means of a homomixer for 20 minutes, to thereby prepare a resin layer coating liquid. To surfaces of spherical magnetite particles having the average particle diameter of 50 μm (1,000 parts), the resin layer coating liquid was applied by means of a fluidized bed coating device, to thereby prepare a carrier.

—Production of Developer—

By means of a ball mill, 5 parts by mass of each of the toners and 95 parts by mass of the carrier were mixed, to thereby produce developers Nos. 1 to 10 corresponding respectively to the toners Nos. 1 to 10 and developers Nos. 11 to 15 corresponding respectively to the toners Nos. 11 to 15.

<<Low Temperature Fixing Ability and Hot Offset Resistance>>

An apparatus provided by modifying a fixing portion of copier IMAGIO MF2200 (product of Ricoh Company, Ltd.) using a TEFLON (registered trademark) roller as a fixing roller was used to perform a copy test on sheets of Type 6200 paper (product of Ricoh Company, Ltd.).

Specifically, a cold offset temperature (minimum fixing temperature) and a hot offset temperature (maximum fixing temperature) were measured by changing the fixing temperature.

Regarding evaluation conditions for the minimum fixing temperature, the paper-feeding linear velocity was set to 120 mm/sec to 150 mm/sec, the surface pressure was set to 1.2 kgf/cm$^2$, and the nip width was set to 3 mm.

Regarding evaluation conditions for the maximum fixing temperature, the paper-feeding linear velocity was set to 50 mm/sec, the surface pressure was set to 2.0 kgf/cm$^2$, and the nip width was set to 4.5 mm.

<<Heat Resistant Storage Stability>>

Each of the toners was stored at 50° C. for 8 hours, and then sieved for 2 minutes with a 42-mesh sieve, to thereby measure a residual rate of the toner on the metal mesh. Here, the better the heat resistant storage stability of the toner, the lower the residual rate.

Note that, evaluation criteria of the heat resistant storage stability are as follows.

A: The residual rate was lower than 10%.

B: The residual rate was 10% or higher but lower than 20%.

C: The residual rate was 20% or higher but lower than 30%.

D: The residual rate was 30% or higher.

<<High-Temperature, High-Humidity Storage Stability>>

Each (5 g) of the toners was stored under an environment of 40° C. and 70% RH for 2 weeks. After that, the toner was sieved on a metal mesh having an opening of 106 m for 5 minutes, and an amount of the toner on the metal mesh was measured and evaluated according to the following evaluation criteria.

[Evaluation Criteria]

A: The amount of the toner on the metal mesh was 0 mg

B: The amount of the toner on the metal mesh was more than 0 mg but less than 2 mg.

C: The amount of the toner on the metal mesh was 2 mg or more but less than 50 mg.

D: The amount of the toner on the metal mesh was 50 mg or more.

<<White Voids after Transfer>>

Each of the developers Nos. 1 to 15 was mounted in IMAGIO MP C2802 (product of Ricoh Company, Ltd.), which was allowed to continuously print out 10,000 sheets each having an A4 image with an image occupation ratio of 5%. After completion of the test, this apparatus was allowed to output three A4 paper sheets of the entire solid image (toner deposition amount: 0.4 mg/cm$^2$), and the number of the white voids in the images was visually measured.

The total number of the white voids in the three images was ranked according to the following criteria.

A: No white voids were visually noticeable in the images of the three sheets.

B: White voids could be observed in the image of the third sheet under an optical microscope, but were not at a practically problematic level.

C: One to ten white voids in the images of the total 3 sheets could visually be observed, and were at a practically problematic level.

D: Eleven or more white voids in the images of the total 3 sheets could visually be observed, and were at a significantly, practically problematic level.

TABLE 1-1

| | | Ex. 1 | Ex. 2 | Ex. 3 | Ex. 4 | Ex. 5 |
|---|---|---|---|---|---|---|
| Toner No. | | 1 | 2 | 3 | 4 | 5 |
| Non-crystalline polyester resin A | Type | A-1 | A-1 | A-1 | A-1 | A-4 |
| | Alcohol | MPD97%/ TMP3% | MPD97%/ TMP3% | MPD97%/ TMP3% | MPD97%/ TMP3% | MPD 100% |
| | Di-carboxylic acid | ADA 100% | ADA 100% | ADA 100% | ADA 100% | IPA40%/ ADA60% |
| | Tg (° C.) | −55 | −55 | −55 | −55 | −40 |
| | Mw | 17,500 | 17,500 | 17,500 | 17,500 | 16,400 |
| | Crosslink component | TMP | TMP | TMP | TMP | TMA |
| Non-crystalline polyester resin B | Type | B-1 | B-2 | B-3 | B-1 | B-1 |
| | Diol | BisA-PO 62%/ BisA-EO 38% | BisA-PO 64%/ BisA-EO 36% | BisA-PO 60%/ BisA-EO 40% | BisA-PO 62%/ BisA-EO 38% | BisA-PO 62%/ BisA-EO 38% |
| | Di-carboxylic acid | TPA93%/ ADA7% | TPA 100% | TPA94%/ ADA6% | TPA93%/ ADA7% | TPA93%/ ADA7% |
| | Tg (° C.) | 67 | 62 | 70 | 67 | 67 |
| | Mw | 5300 | 4300 | 8700 | 5300 | 5300 |
| Crystalline polyester resin C | Type | C-1 | C-1 | C-1 | C-2 | C-1 |
| | Diol | HD100% | HD100% | HD100% | HD100% | HD100% |
| | Di-carboxylic acid | Sebacic acid 100% | Sebacic acid 100% | Sebacic acid 100% | Sebacic acid 100% | Sebacic acid 100% |
| | Tm (° C.) | 67 | 67 | 67 | 65 | 67 |
| | Mw | 25000 | 25000 | 25000 | 15000 | 25000 |
| Compositional ratio | Resin A | 16 | 16 | 16 | 16 | 16 |
| | Resin B | 65 | 65 | 65 | 65 | 65 |
| | Resin C | 10 | 10 | 10 | 10 | 10 |
| | Releasing agent | 6 | 6 | 6 | 6 | 6 |
| | Colorant | 6 | 6 | 6 | 6 | 6 |

TABLE 1-2

| | | Ex. 1 | Ex. 2 | Ex. 3 | Ex. 4 | Ex. 5 |
|---|---|---|---|---|---|---|
| Toner No. | | 1 | 2 | 3 | 4 | 5 |
| Properties of toner | G'(50) (Pa) | $1.5 \times 10^8$ | $5.1 \times 10^7$ | $2.4 \times 10^8$ | $9.0 \times 10^7$ | $2.9 \times 10^8$ |
| | G'(60) (Pa) | $3.2 \times 10^5$ | $2.6 \times 10^5$ | $2.3 \times 10^6$ | $2.0 \times 10^5$ | $1.0 \times 10^7$ |
| | Relaxing time T (ms) | 0.3 | 0.7 | 0.2 | 0.9 | 0.5 |

TABLE 1-2-continued

| | | | Ex. 1 | Ex. 2 | Ex. 3 | Ex. 4 | Ex. 5 |
|---|---|---|---|---|---|---|---|
| | tanδ Peak value temp. (° C.) | | 55 | 48 | 64 | 53 | 51 |
| | TMA deformation amount (%) | | 7 | 19 | 5 | 25 | 10 |
| | Tg1st (° C.) | | 43 | 40 | 44 | 41 | 38 |
| | Tg2nd (° C.) | | 22 | 20 | 21 | 19 | 29 |
| | Tg1st − Tg2nd (° C.) | | 21 | 20 | 23 | 22 | 9 |
| | In-soluble matter G*' | G*($60_{THF}$) (Pa) | $5.5 \times 10^5$ | $4.8 \times 10^5$ | $9.5 \times 10^5$ | $5.1 \times 10^5$ | $5.9 \times 10^5$ |
| Quality of toner | Fixing | Lowest (° C.) | 100 | 95 | 105 | 100 | 105 |
| | | Highest (° C.) | 200 | 190 | 200 | 185 | 195 |
| | Heat resistant storage stability | | A | B | A | A | A |
| | High-temp., high-humidity storage stability | | A | B | A | B | B |
| | White voids after transfer | | A | A | A | B | B |

TABLE 1-3

| | | Ex. 6 | Ex. 7 | Ex. 8 | Ex. 9 | Ex. 10 |
|---|---|---|---|---|---|---|
| Toner No. | | 6 | 7 | 8 | 9 | 10 |
| Non-crystal-line polyester resin A | Type | A-3 | A-1 | A-1 | A-1 | A-2 |
| | Alcohol | MPD97%/ TMP3% | MPD97%/ TMP3% | MPD97%/ TMP3% | MPD97%/ TMP3% | MPD97%/ TMP3% |
| | Di-carboxylic acid | TPA60%/ ADA40% | ADA 100% | ADA 100% | ADA 100% | Decane-dioic acid 100% |
| | Tg (° C.) | −5 | −55 | −55 | −55 | −70 |
| | Mw | 19,100 | 17,500 | 17,500 | 17,500 | 19,000 |
| | Crosslink component | TMP | TMP | TMP | TMP | TMP |
| Non-crystal-line polyester resin B | Type | B-1 | B-1 | B-1 | B-1 | B-3 |
| | Diol | BisA-PO 62%/ BisA-EO 38% | BisA-PO 62%/ BisA-EO 38% | BisA-PO 62%/ BisA-EO 38% | BisA-PO 62%/ BisA-EO 38% | BisA-PO 60%/ BisA-EO 40% |
| | Di-carboxylic acid | TPA93%/ ADA7% | TPA93%/ ADA7% | TPA93%/ ADA7% | TPA93%/ ADA7% | TPA94%/ ADA6% |
| | Tg (° C.) | 67 | 67 | 67 | 67 | 70 |
| | Mw | 5300 | 5300 | 5300 | 5300 | 8700 |
| Crystal-line polyester resin C | Type | C-1 | C-3 | C-4 | C-1 | C-1 |
| | Diol | HD100% | HD100% | HD100% | HD100% | HD100% |
| | Di-carboxylic acid | Sebacic acid 100% | Sebacic acid 100% | ADA 100% | Sebacic acid 100% | Sebacic acid 100% |
| | Tm (° C.) | 67 | 67 | 60 | 67 | 67 |
| | Mw | 25000 | 32000 | 25000 | 25000 | 25000 |
| Compositional ratio | Resin A | 16 | 16 | 16 | 16 | 16 |
| | Resin B | 65 | 65 | 65 | 60 | 65 |
| | Resin C | 10 | 10 | 10 | 15 | 10 |
| | Releasing agent | 6 | 6 | 6 | 6 | 6 |
| | Colorant | 6 | 6 | 6 | 6 | 6 |

TABLE 1-4

| | | Ex. 6 | Ex. 7 | Ex. 8 | Ex. 9 | Ex. 10 |
|---|---|---|---|---|---|---|
| | Toner No. | 6 | 7 | 8 | 9 | 10 |
| Properties of toner | G'(50) (Pa) | $2.8 \times 10^8$ | $2.2 \times 10^8$ | $4.2 \times 10^7$ | $7.0 \times 10^7$ | $1.5 \times 10^8$ |
| | G'(60) (Pa) | $8.1 \times 10^6$ | $8.7 \times 10^6$ | $3.4 \times 10^5$ | $1.9 \times 10^5$ | $3.2 \times 10^5$ |
| | Relaxing time T (ms) | 0.8 | 0.2 | 1.0 | 0.8 | 0.3 |
| | tanδ Peak value temp. (° C.) | 58 | 61 | 49 | 52 | 59 |
| | TMA deformation amount (%) | 13 | 8 | 17 | 18 | 7 |

TABLE 1-4-continued

| | | | Ex. 6 | Ex. 7 | Ex. 8 | Ex. 9 | Ex. 10 |
|---|---|---|---|---|---|---|---|
| | Tg1st (° C.) | | 46 | 47 | 38 | 40 | 41 |
| | Tg2nd (° C.) | | 22 | 22 | 18 | 20 | 22 |
| | Tg1st − Tg2nd (° C.) | | 24 | 25 | 20 | 20 | 19 |
| | In-soluble matter G*' | G*($60_{THF}$) (Pa) | $5.1 \times 10^6$ | $5.6 \times 10^5$ | $8.9 \times 10^5$ | $9.3 \times 10^5$ | $5.2 \times 10^5$ |
| Quality of toner | Fixing | Lowest (° C.) | 105 | 110 | 95 | 95 | 100 |
| | | Highest (° C.) | 195 | 205 | 180 | 185 | 200 |
| | Heat resistant storage stability | | B | A | B | B | A |
| | High-temp., high-humidity storage stability | | A | A | B | B | A |
| | White voids after transfer | | A | B | B | B | A |

TABLE 1-5

| | | Comp. Ex. 1 | Comp. Ex. 2 | Comp. Ex. 3 | Comp. Ex. 4 | Comp. Ex. 5 |
|---|---|---|---|---|---|---|
| Toner No. | | 11 | 12 | 13 | 14 | 15 |
| Non-crystal-line polyester resin A | Type | A-2 | A-1 | A-1 | A-2 | A-4 |
| | Alcohol | MPD97%/ TMP3% | MPD97%/ TMP3% | MPD97%/ TMP3% | MPD97%/ TMP3% | MPD 100% |
| | Di-carboxylic acid | Decane-dioic acid 100% | ADA 100% | ADA 100% | Decane-dioic acid 100% | IPA40%/ ADA60% |
| | Tg (° C.) | −70 | −55 | −55 | −70 | −40 |
| | Mw | 19,000 | 17,500 | 17,500 | 19,000 | 16,400 |
| | Crosslink component | TMP | TMP | TMP | TMP | TMA |
| Non-crystal-line polyester resin B | Type | B-4 | B-2 | B-3 | B-2 | B-4 |
| | Diol | BisA-EO 85%/ BisA-PO 15% | BisA-PO 64%/ BisA-EO 36% | BisA-PO 60%/ BisA-EO 40% | BisA-PO 64%/ BisA-EO 36% | BisA-EO 85%/ BisA-PO 15% |
| | Di-carboxylic acid | IPA80%/ ADA20% | TPA 100% | TPA94%/ ADA6% | TPA 100% | IPA80%/ ADA20% |
| | Tg (° C.) | 45 | 62 | 70 | 62 | 45 |
| | Mw | 5000 | 4300 | 8700 | 4300 | 5000 |
| Crystal-line polyester resin C | Type | C-2 | C-4 | C-3 | C-2 | C-5 |
| | Diol | HD100% | HD100% | HD100% | HD100% | HD100% |
| | Di-carboxylic acid | Sebacic acid 100% | ADA 100% | Sebacic acid 100% | Sebacic acid 100% | Decane-dioic acid 100% |
| | Tm (° C.) | 65 | 60 | 67 | 65 | 70 |
| | Mw | 15000 | 25000 | 32000 | 15000 | 15,000 |
| Compositional ratio | Resin A | 16 | 16 | 16 | 16 | 15 |
| | Resin B | 55 | 65 | 65 | 65 | 70 |
| | Resin C | 20 | 18 | 10 | 10 | 5 |
| | Releasing agent | 6 | 6 | 6 | 6 | 5 |
| | Colorant | 6 | 6 | 6 | 6 | 5 |

TABLE 1-6

| | | Comp. Ex. 1 | Comp. Ex. 2 | Comp. Ex. 3 | Comp. Ex. 4 | Comp. Ex. 5 |
|---|---|---|---|---|---|---|
| | Toner No. | 11 | 12 | 13 | 14 | 15 |
| Properties of toner | G'(50) (Pa) | $2.5 \times 10^7$ | $4.0 \times 10^7$ | $4.2 \times 10^8$ | $3.1 \times 10^7$ | $1.9 \times 10^7$ |
| | G'(60) (Pa) | $1.0 \times 10^5$ | $9.1 \times 10^4$ | $2.1 \times 10^7$ | $2.0 \times 10^5$ | $1.2 \times 10^5$ |
| | Relaxing time T (ms) | 0.8 | 0.9 | 0.7 | 1.1 | 0.8 |
| | tanδ Peak value temp. (° C.) | 50 | 50 | 62 | 52 | 45 |
| | TMA deformation amount (%) | 20 | 18 | 3 | 25 | 28 |
| | Tg1st (° C.) | 37 | 35 | 47 | 38 | 30 |

TABLE 1-6-continued

| | | | Comp. Ex. 1 | Comp. Ex. 2 | Comp. Ex. 3 | Comp. Ex. 4 | Comp. Ex. 5 |
|---|---|---|---|---|---|---|---|
| | Tg2nd (° C.) | | 20 | 20 | 23 | 18 | 15 |
| | Tg1st − Tg2nd (° C.) | | 17 | 15 | 24 | 20 | 15 |
| | In-soluble matter G*' | G*($60_{THF}$) (Pa) | $4.9 \times 10^4$ | $5.1 \times 10^4$ | $5.1 \times 10^4$ | $4.7 \times 10^4$ | $6.1 \times 10^5$ |
| Quality of toner | Fixing | Lowest (° C.) | 95 | 95 | 125 | 95 | 95 |
| | | Highest (° C.) | 190 | 175 | 205 | 180 | 190 |
| | Heat resistant storage stability | | D | D | A | C | B |
| | High-temp., high-humidity storage stability | | D | D | A | D | D |
| | White voids after transfer | | D | C | A | D | C |

In Tables 1-1, 1-3 and 1-5, "Compositional ratio (% by mass)" shows compositional ratios (% by mass) of the resin A, the resin B, the resin C, the releasing agent, and the colorant, relative to the total amount of them.

"BisA-EO" means bisphenol A ethylene oxide 2 mol adduct.

"BisA-PO" means bisphenol A propylene oxide 3 mol adduct.

Regarding the crosslink component, "TMP" means trimethylolpropane and "TMA" means trimellitic anhydride. "TMA deformation amount" in this table, which is one property of the each of the obtained toners, means a compression deformation amount obtained by Thermomechanical Analysis already specifically described and defined herein. That is, "TMA" in "TMA deformation amount" means Thermomechanical Analysis, and "TMA deformation amount" (TMA %) is measured at 40° C. and a relative humidity of 70%. "HD" means 1,6-hexanediol. "MPD" means 3-methyl-1,5-pentanediol. "ADA" means adipic acid. "IPA" means isophthalic acid. "TPA" means terephthalic acid. The unit "%" in the composition of the diol and dicarboxylic acid of each resin is "mol %".

10 Photoconductor drum
18 Image forming unit
20 Charging roller
21 Exposing device
22 Secondary transfer unit
25 Fixing device
26 Fixing belt
27 Press roller
42(K, Y, M, C) Developer container
43(K, Y, M, C) Developer supply roller
44(K, Y, M, C) Developing roller
45(K, Y, M, C) Developing device
50 Intermediate transfer member
60 Charging roller
61 Developing device
62 Transfer roller
70 Developing device
95 Recording paper
100A Image forming apparatus
100B Image forming apparatus
120 Tandem type developing device
L Light for exposure

The invention claimed is:

1. A toner, comprising:

a colorant;

a binder resin comprising (A) a non-crystalline polyester resin having a glass transition temperature from −70 to −5° C. and comprising a diol component as a constituent component thereof, wherein the diol component comprises an aliphatic diol comprising 3 to 10 carbon atoms in an amount of 50 mol % or more, and trimethylolpropane as a crosslink component, (B) a non-crystalline polyester resin having a glass transition temperature from 40-80° C. and comprising, in polymerized form, more moles of aromatic monomers than aliphatic monomers, and (C) a crystalline polyester resin; and a releasing agent, wherein the toner satisfies requirements (1) and (2) below:

(1): $G'(50) \geq 3.0 \times 10^7$ Pa and $1.0 \times 10^5$ Pa $\leq G'(60) \leq 1.0 \times 10^7$ Pa, wherein G'(50) is a storage modulus at 50° C. of the toner and G'(60) is a storage modulus at 60° C. of the toner; and (2): a spin-spin relaxation time of the toner at 50° C. measured by solid echo method of pulse NMR is 1.0 ms or shorter.

2. The toner according to claim 1, wherein a storage modulus at 60° C. of THF insoluble matter of the toner, represented by [G*(60)], satisfies $G^*(60) \leq 1.0 \times 10^6$ Pa.

3. The toner according to claim 1, wherein a difference between a glass transition temperature of the toner measured in first heating Tg1st and a glass transition temperature of the toner measured in second heating Tg2nd in differential scanning calorimetry is 10° C. or more, wherein the difference between the Tg1st and the Tg2nd is measured by performing the first heating from −80° C. to 150° C. at a heating rate of 10° C./min, cooling from 150° C. to −80° C. at a cooling rate of 10° C./min, and then performing the second heating from −80° C. to 150° C. at a heating rate of 10° C./min.

4. The toner according to claim 1, wherein the toner has a TMA compression deformation amount TMA % of 15% or less, where the TMA % is measured with a compression force of 100 mN at 40° C. and a relative humidity of 70%.

5. The toner according to claim 1, wherein a maximum value of a loss tangent in the toner is 60° C. or less.

6. A developer, comprising:
the toner according to claim 1.
7. A toner accommodating container, comprising:
the toner according to claim 1; and
a container, which accommodates the toner.
8. An image forming method, comprising:
developing an electrostatic latent image formed on a surface of an electrostatic latent image bearing member with the toner according to claim 1 to form a visible image;
transferring the visible image onto a recording medium; and
fixing the visible image transferred onto the recording medium.
9. The toner according to claim 1, wherein the non-crystalline polyester resin (B) is a linear polyester resin comprising a diol component and a dicarboxylic acid component as a constituent components thereof, wherein the diol consists essentially of adducts of bisphenol A with $C_{2-3}$ alkylene oxides, hydrogenerated bisphenol A, and/or adducts of hydrogenerated bisphenol A with $C_{2-3}$ alkylene oxides.
10. The toner according to claim 1, wherein the non-crystalline polyester resin (B) has a weight average molecular weight, Mw, from 3,000 to 10,000.
11. A toner, comprising:
a colorant;
a binder resin comprising
(A) a non-crystalline polyester resin having a glass transition temperature from −70 to −5° C. and comprising
a diol component as a constituent component thereof, wherein the diol component comprises an aliphatic diol comprising 3 to 10carbon atoms in an amount of 50 mol % or more, and
a trivalent or higher acid or a trihydric or higher alcohol as a crosslink component,
(B) a non-crystalline polyester resin having a glass transition temperature from 40-80° C. and comprising, in polymerized form, more moles of aromatic monomers than aliphatic monomers, and
(C) a crystalline polyester resin having a weight average molecular weight, Mw, from 25,000 to 32,000; and
a releasing agent,
wherein the toner satisfies requirements (1) and (2) below:
(1): $G'(50) \geq 3.0\times10^7$ Pa and $1.0\times10^5$ Pa$\leq G'(60) \leq 1.0\times10^7$ Pa, wherein G'(50) is a storage modulus at 50° C. of the toner and G'(60) is a storage modulus at 60° C. of the toner; and
(2): a spin-spin relaxation time of the toner at 50° C. measured by solid echo method of pulse NMR is 1.0 ms or shorter.
12. A developer, comprising:
the toner according to claim 11.
13. A toner accommodating container, comprising:
the toner according to claim 11; and
a container, which accommodates the toner.
14. An image forming method, comprising:
developing an electrostatic latent image formed on a surface of an electrostatic latent image bearing met ber with the toner according to claim 11 to form a visible image;
transferring the visible image onto a recording medium; and
fixing the visible image transferred onto the recording medium.
15. A toner, comprising:
a colorant;
a hinder resin comprising
(A) a non-crystalline polyester resin having a glass transition temperature from −70 to −5° C. and comprising
a diol component as a constituent component thereof, wherein the diol component comprises an aliphatic diol comprising 3 to 10 carbon atoms in an amount of 50 mol % or more, and
a trivalent or higher acid or a trihydric or higher alcohol as a crosslink component,
(B) a non-crystalline polyester resin having a glass transition temperature from 40-80° C. and comprising, in polymerized form more moles of aromatic monomers than aliphatic monomers, and
(C) a crystalline polyester resin; and
a releasing agent,
wherein an amount of the non-crystalline polyester resin (B) is from 50 parts by mass to 80 parts by mass relative to 100 parts by mass of the toner,
wherein a difference between a glass transition temperature of the toner measured in first heating Tg1st and a glass transition temperature of the toner measured in second heating Tg2nd in differential scanning calorimetry is 20° C. or more, wherein the difference between the Tg1st and the Tg2nd is measured by performing the first heating from −80° C. to 150° C. at a heating rate of 10° C./min, cooling from 150° C. to −80° C. at a cooling rate of 10° C./min, and then performing the second heating from −80° C. to 150° C. at a heating rate of 10° C./min, and
wherein the toner satisfies requirements (1) and (2) below:
(1): $G'(50) \geq 3.0\times10^7$ Pa and $1.0\times10^5$ Pa$\leq G'(60) \leq 1.0\times10^7$ Pa, wherein G'(50) is a storage modulus at 50° C. of the toner and G'(60) is a storage modulus at 60° C. of the toner; and
(2): a spin-spin relaxation time of the toner at 50° C. measured by solid echo method of pulse NMR is 1.0 ms or shorter.
16. The toner according to claim 15, wherein the difference of Tg1st−Tg2nd is 20° C. to 25° C.
17. A developer, comprisin
the toner according to claim 15.
18. A toner accommodating container, comprising:
the toner according to claim 15; and
a container, which accommodates the toner.
19. An image forming method, comprising:
developing an electrostatic latent image formed on a surface of an electrostatic latent image hearing member with the toner according to claim 15 to form a visible image;
transferring the visible image onto a recording medium; and
fixing the visible image transferred onto the recording medium.
20. The toner according to claim 15, wherein an amount of the non-crystalline polyester resin (B) is from 60 parts by mass to 80 parts by mass relative to 100 parts by mass of the toner.

* * * * *